US008104858B2

(12) United States Patent
Kato et al.

(10) Patent No.: US 8,104,858 B2
(45) Date of Patent: Jan. 31, 2012

(54) INKJET HEAD

(75) Inventors: Masahito Kato, Nagoya (JP); Manabu Hibi, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 451 days.

(21) Appl. No.: 12/341,025

(22) Filed: Dec. 22, 2008

(65) Prior Publication Data

US 2009/0167820 A1 Jul. 2, 2009

(30) Foreign Application Priority Data

Dec. 28, 2007 (JP) ..... 2007-338959
Dec. 28, 2007 (JP) ..... 2007-338960

(51) Int. Cl.
*B41J 29/38* (2006.01)
*B41J 2/05* (2006.01)
*B41J 2/045* (2006.01)

(52) U.S. Cl. ..... 347/17; 347/5; 347/19; 347/20; 347/54; 347/56; 347/63; 347/65; 347/68; 347/69; 347/70

(58) Field of Classification Search ..... 347/17, 347/56, 65, 70
See application file for complete search history.

(56) References Cited

U.S. PATENT DOCUMENTS

2006/0221143 A1* 10/2006 Kodama ..... 347/70

* cited by examiner

*Primary Examiner* — Ryan Lepisto
(74) *Attorney, Agent, or Firm* — Banner & Witcoff, Ltd.

(57) ABSTRACT

An inkjet head may comprise an ejection port which ejects ink and an ink flow path which supplies the ink to the ejection port. The inkjet head may also comprise an ejection actuator which supplies ejection energy to the ink in the ink flow path. The ejection energy may cause the ink to be ejected from the ejection port. The inkjet head may also comprise a wall portion. The wall portion may be located at a position farther from the ejection port along the ink flow path with respect to a position at which the ejection energy is supplied. The wall portion may define an inner wall surface of the ink flow path. The wall portion may deform to decrease a cross section of the ink flow path in a direction orthogonal to an ink-flow direction as a temperature of the ink in the ink flow path increases. The wall portion may deform to increase a cross section of the ink flow path in a direction orthogonal to an ink-flow direction as the temperature of the ink in the ink flow path decreases.

17 Claims, 15 Drawing Sheets

INKJET HEAD

CROSS REFERENCE TO RELATED APPLICATION

This application claims priority to Japanese Patent Applications No. 2007-338959, filed Dec. 28, 2007, and No. 2007-338960, filed Dec. 28, 2007, the entire subject matter and disclosure of which are incorporated herein by reference.

BACKGROUND OF THE DISCLOSURE

1. Field of the Disclosure

The features herein relate to an inkjet head which ejects ink.

2. Description of the Related Art

In an inkjet head, having an ejection port which ejects ink and an ink flow path which supplies ink to the ejection port, ink ejection characteristics may be changed depending on an ink temperature.

Meanwhile, a performance of re-filling ink to the ejection port in the ink flow path may be changed depending on the ink temperature after ink ejection. For example, when the ink temperature increases, the ink easily flows, and hence, the ink is easily re-filled. In contrast, when the ink temperature decreases, the ink slowly flows, and hence, the ink is slowly re-filled. The change in ink ejection characteristics may be caused by the change in such performance of re-filling the ink.

For example, if the ink flow path is designed such that the ink is re-filled by a suitable amount when the ink temperature is high, the ink amount to be re-filled at a low ink temperature becomes insufficient. Thus, the ink ejection amount from the ejection port may become insufficient. In contrast, if the ink flow path is designed such that the ink is re-filled by the suitable amount when the ink temperature is low, the ink amount to be re-filled at a high ink temperature becomes excessive. Thus, the ink ejection amount from the ejection port may become excessive.

An inkjet head which adjusts ink ejection characteristics by deforming an ink flow path in accordance with an ink temperature is known. However, in the inkjet head, the ink flow path is deformed by using thermal expansion of the wall portion. In this case, the appearance of the deformation of the wall portion depending on the change in ink temperature is determined by the material, shape, and supporting method of the wall portion. Thus, it is difficult to adjust the wall portion to be deformed appropriately in accordance with the change in temperature.

SUMMARY

There is a need for an inkjet head which is easily adjusted to deform an ink flow path in response to a change in ink temperature.

According to an aspect of the invention, an inkjet head comprises an ejection port which ejects ink; an ink flow path which supplies the ink to the ejection port; an ejection actuator which supplies ejection energy to the ink in the ink flow path, the ejection energy causing the ink to be ejected from the ejection port; and a wall portion located at a position farther from the ejection port along the ink flow path with respect to a position at which the ejection energy is supplied, the wall portion defining an inner wall surface of the ink flow path; wherein the wall portion deforms to decrease a cross section of the ink flow path in a direction orthogonal to an ink-flow direction as a temperature of the ink in the ink flow path increases, and the wall portion deforms to increase a cross section of the ink flow path in a direction orthogonal to an ink-flow direction as the temperature of the ink in the ink flow path decreases.

Other objects, features and advantages will be apparent to those skilled in the art from the following detailed description and accompanying drawings.

BRIEF DESCRIPTION OF THE DRAWINGS

Embodiments of the invention now are described with reference to the accompanying drawings, which are given by way of example only, and are not intended to limit the patent.

FIG. 4 plots pressure chambers 110, apertures 112, and nozzles 108.

FIG. 10 plots pressure chambers 110, apertures 112, and nozzles 108.

DETAILED DESCRIPTION OF EMBODIMENTS

Embodiments of the present invention, and their features and advantages, may be understood by referring to FIGS. 1-15, like numerals being used for corresponding parts in the various drawings.

Figure 1:
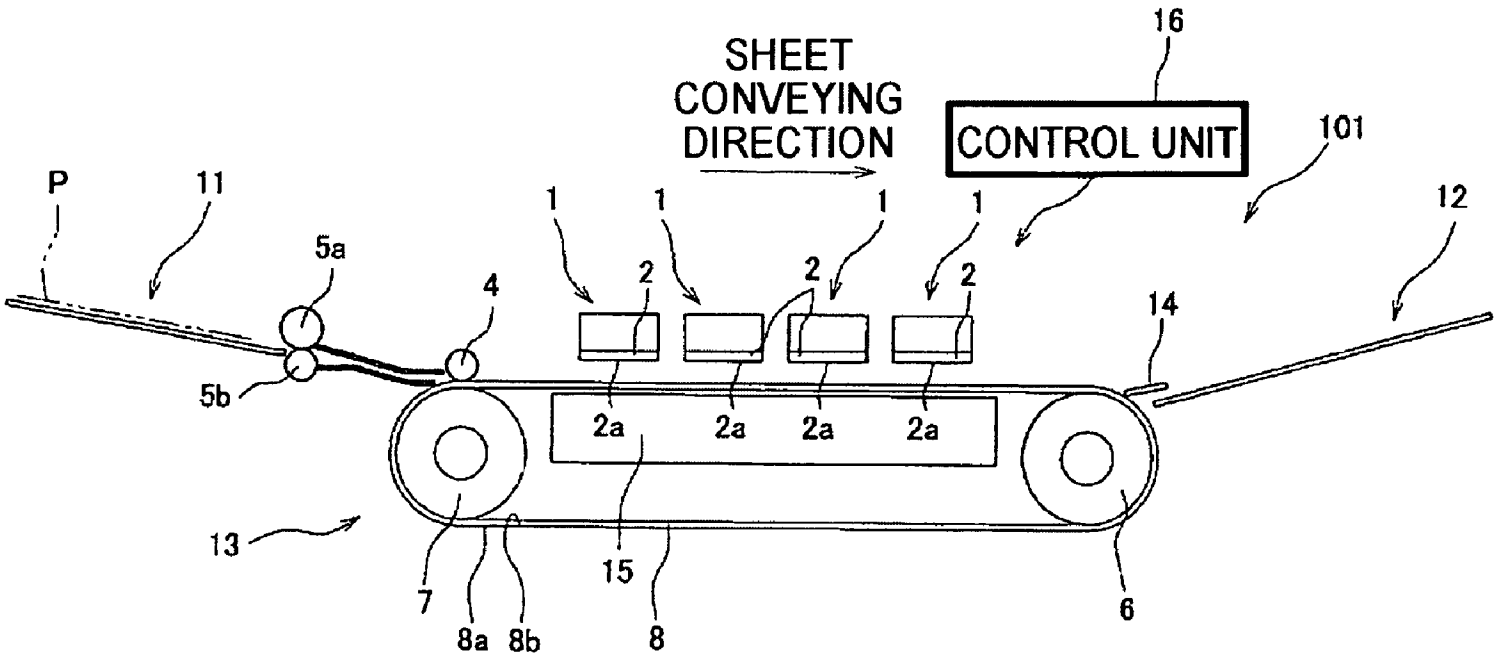
FIG. 1 is a side view of an inkjet printer according to an embodiment.

Referring to FIG. 1, an inkjet printer 101 may be a color inkjet printer comprising a plurality of, e.g., four, inkjet heads 1. The inkjet printer 101 may comprise a control unit 16. The control unit 16 may control operations of respective components of the inkjet printer 101. The inkjet printer 101 may comprise a feed section 11 on the left side in the drawing, and a discharge section 12 on the right side in the drawing.

A sheet-conveying path may be positioned in the inkjet printer 101. A sheet P may be conveyed from the feed section 11 to the discharge section 12 through the sheet-conveying path. A pair of feed rollers 5*a* and 5*b* may be arranged directly downstream of the feed section 11. The feed rollers 5*a* and 5*b* may nip and convey the sheet P. The pair of feed rollers 5*a* and 5*b* may feed the sheet P from the feed section 11 toward the right side in the drawing. A belt conveying mechanism 13 may be positioned at an intermediate portion of the sheet-conveying path. The belt conveying mechanism 13 may comprise a plurality of, e.g., two, belt rollers 6 and 7, an endless conveying belt 8 and a platen 15. The conveying belt 8 may be wound around both belt rollers 6 and 7. The platen 15 may be positioned at a position opposing the inkjet heads 1 within a region surrounded by the conveying belt 8. The platen 15 may support the conveying belt 8 in a region opposing the inkjet head 1, in order to prevent the conveying belt 8 from being bent downward. A nip roller 4 may be positioned at a position opposing the belt roller 7. The nip roller 4 may press the sheet P, which is fed from the feed section 11 by the feed rollers 5*a* and 5*b*, to an outer peripheral surface 8*a* of the conveying belt 8.

When a conveying motor rotates the belt roller 6, the conveying belt 8 may travel. The conveying belt 8 may convey the sheet P, which is pressed to the outer peripheral surface 8*a* by the nip roller 4, to the discharge section 12 while adhesively holding the sheet P. A low-adhesive silicone resin layer may be positioned on the surface of the conveying belt 8.

A separation mechanism 14 may be positioned directly downstream of the conveying belt 8 along the sheet-conveying path. The separation mechanism 14 may separate the sheet P, which adheres on the outer peripheral surface 8*a* of the conveying belt 8, from the outer peripheral surface 8*a*, and feed the sheet P to the discharge section 12 located on the right side in the drawing.

The plurality of, e.g., four, inkjet heads 1 corresponding to a plurality of, e.g., four, color inks (magenta, yellow, cyan, black) may be aligned and positioned in a conveying direction. The inkjet printer 101 may be a line printer. The plurality of inkjet heads 1 respectively may have head bodies 2 at lower ends thereof. Each head body 2 may have a rectangular-parallelepiped shape elongated in a direction orthogonal to the conveying direction. Bottom surfaces of the head bodies 2 may function as ink ejection surfaces 2*a* which oppose the outer peripheral surface 8*a*. When the sheet P conveyed by the conveying belt 8 passes through an area directly below the plurality of head bodies 2, the color inks may be respectively ejected from the ink ejection surfaces 2*a* onto an upper surface, namely, a print surface of the sheet P. Hence, a desired color image may be able to be formed on the print surface of the sheet P.

Figure 2:
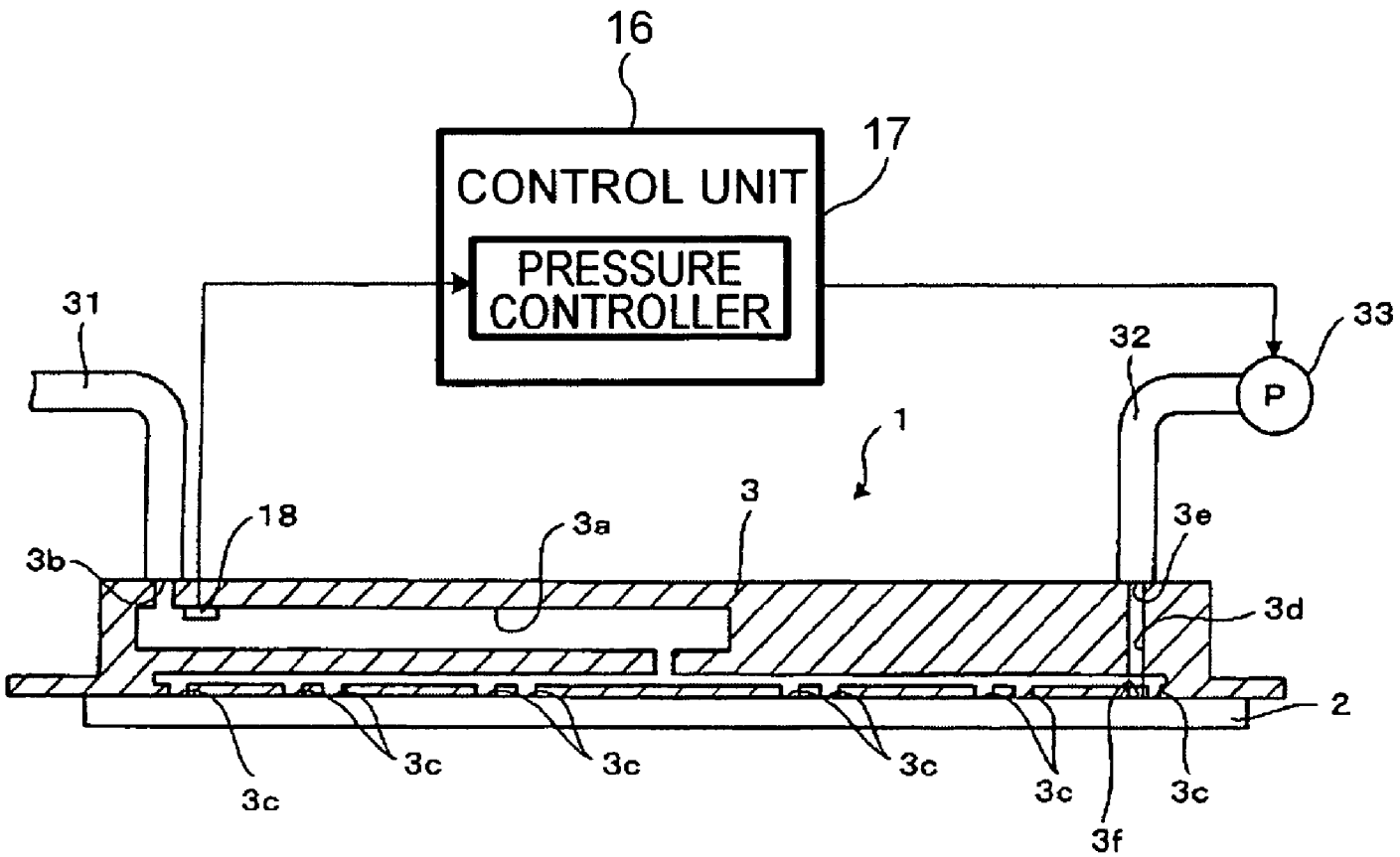
FIG. 2 is a side view including a partial cross-sectional view of the inkjet head in FIG. 1.

Referring to FIG. 2, the inkjet head 1 may comprise a reservoir unit 3 which supplies ink to the head body 2. An ink flow path 3*a* may be formed in the reservoir unit 3. An opening 3*b* of the ink flow path 3*a* may be formed in an upper surface of the reservoir unit 3. A plurality of openings 3*c* of the ink flow path 3*a* may be formed in a lower surface of the reservoir unit 3. The opening 3*b* may communicate with an ink tube 31. The openings 3*c* may communicate with manifold flow paths 105 formed in the head body 2. The ink tube 31 may communicate with an ink tank. Ink may be supplied from the ink tank into the ink flow path 3*a* through the ink tube 31 and the opening 3*b*. The ink supplied into the ink flow path 3*a* may be supplied to the head body 2.

A temperature sensor 18 may be positioned in the ink flow path 3*a*. The temperature sensor 18 may detect the temperature of the ink in the ink flow path 3*a*, and transmit the detection result to the control unit 16. The control unit 16 may comprise a pressure controller 17. The pressure controller 17 may control the operation of a pump 33 based on the detection result of the temperature sensor 18.

An air flow path 3*d* may be formed in the reservoir unit 3 at a position at which the ink flow path 3*a* is not formed. An opening 3*e* of the air flow path 3*d* may be formed in the upper surface of the reservoir unit 3. An opening 3*f* of the air flow path 3*d* may be formed in the lower surface of the reservoir unit 3. The opening 3*e* may communicate with an air tube 32. The air tube 32 may be connected to the pump 33. The opening 3*f* may communicate with an air flow path 141 formed in the head body 2. The pump 33 may change the pressure in the air flow path 141 of the head body 2 through the air tube 32 and the air flow path 3*d*. The pump 33 may be, for example, a cylinder pump, a tube pump, or a roller pump.

Figure 3:
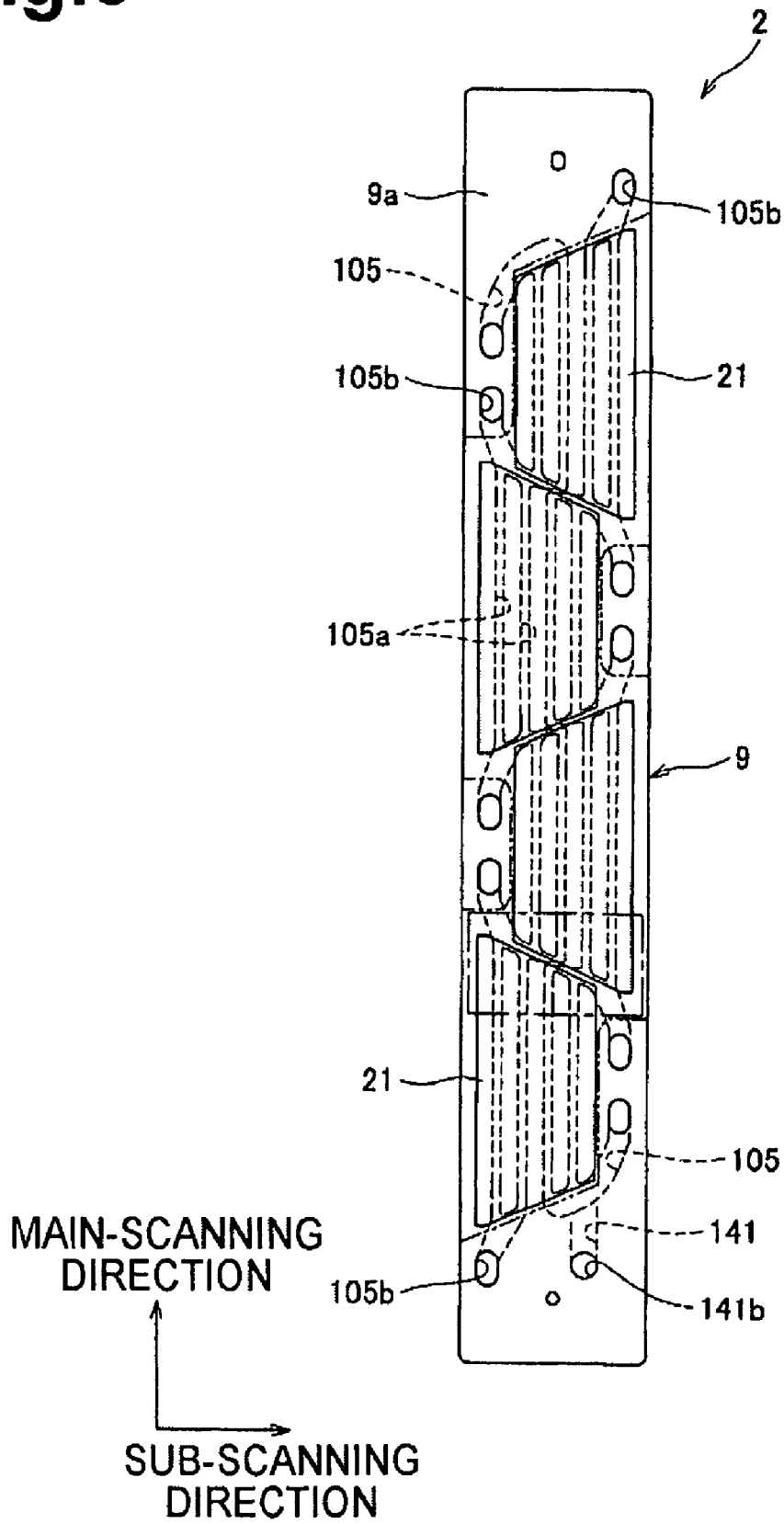
FIG. 3 is a plan view of an inkjet head body in FIG. 1.

Referring to FIG. 3, the head body 2 may comprise a flow-path unit 9 and an actuator unit 21. The inkjet head 1 may also comprise a driver IC which generates a driving signal for driving the actuator unit 21. A signal from the driver IC may be supplied to the actuator unit 21 via a flexible printed cable in which a signal line is arranged.

Figure 4:
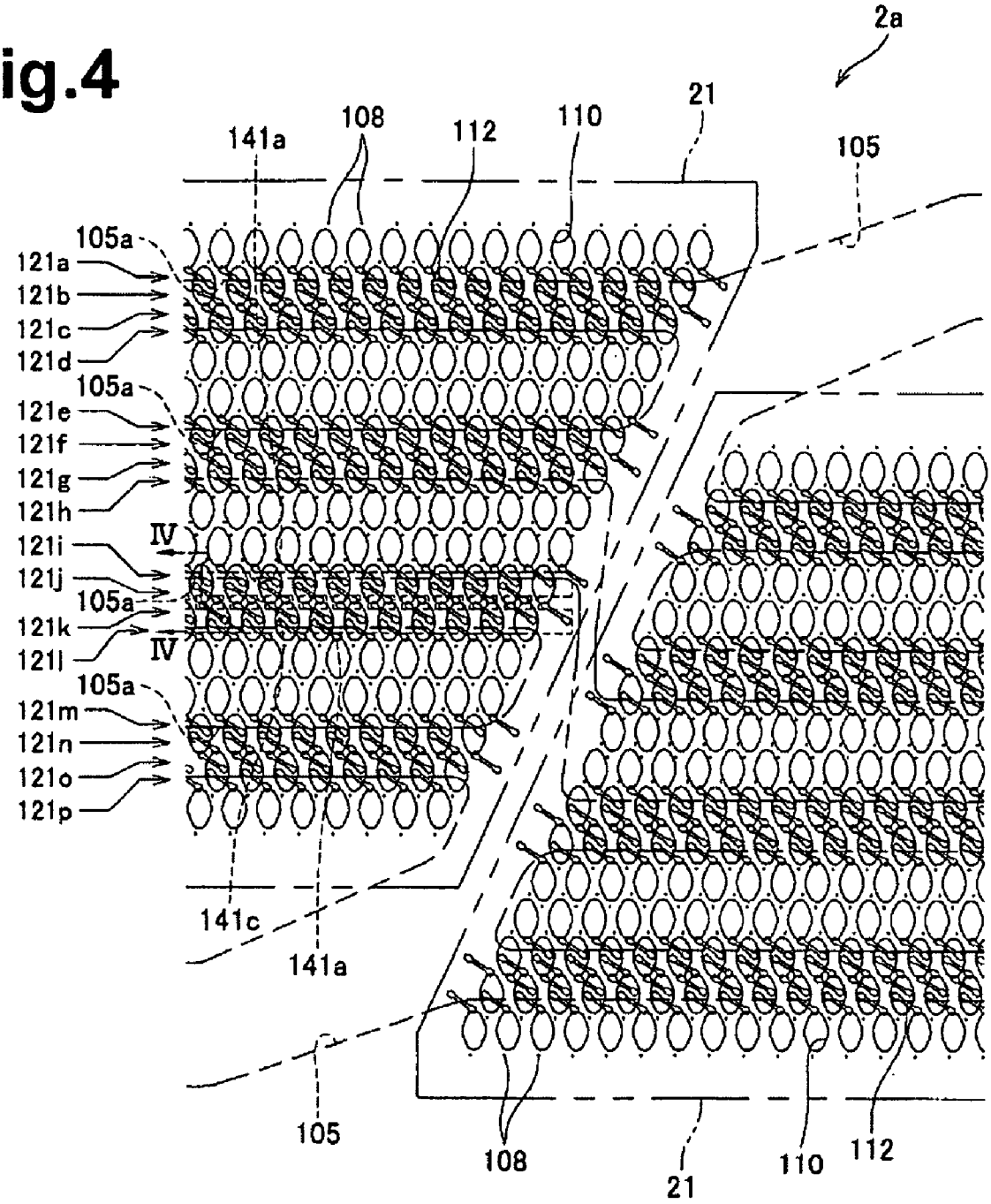
FIG. 4 is an enlarged view of a region surrounded by a dotted line in FIG. 3.

The head body 2 may comprise a flow-path unit 9, and a plurality of, e.g., four, actuator units 21 positioned onto an upper surface 9*a* of the flow-path unit 9. Referring to FIG. 4, an ink flow path containing pressure chambers 110 etc., and an air flow path to be filled with the air may be formed inside the flow-path unit 9. Each actuator unit 21 may comprise a plurality of actuators respectively corresponding to the pressure chambers 110. The actuator unit 21 may apply ejection energy selectively to ink in the pressure chambers 110.

The flow-path unit 9 may have a rectangular-parallelepiped shape. A plurality of, e.g. ten, ink supply ports 105*b*, may be formed in the upper surface 9*a* of the flow-path unit 9. The ink supply ports 105*b* may correspond to the openings 3*c* of the reservoir unit 3. Manifold flow paths 105 and sub-manifold flow paths 105*a* may be formed in the flow-path unit 9. The manifold flow paths 105 may communicate with the ink supply ports 105*b*. The sub-manifold flow paths 105*a* may split from the manifold flow paths 105. The sub-manifold flow paths 105*a* may be positioned at a lower portion of each actuator unit 21, and may extend in parallel to a longitudinal direction of the flow-path unit 9. The ink ejection surface 2*a* may be positioned on a lower surface of the flow-path unit 9. A plurality of nozzles 108 may be arranged in a matrix in the ink ejection surface 2*a*. The pressure chambers 110 may be arrayed in a matrix in a fixing surface of the flow-path unit 9, on which the actuator unit 21 is fixed.

The array of the pressure chambers 110 may be composed of a plurality of, e.g., sixteen, rows of pressure chambers 110 arranged in parallel to a short-side direction of the flow-path unit 9, each row having a plurality of pressure chambers 110 arranged at regular intervals in a longitudinal direction of the flow-path unit 9. The number of pressure chambers 110 contained in each row may gradually decrease from a long side toward a short side of the actuator unit 21 to be consistent with an external shape, e.g., trapezoidal shape, of the actuator unit 21. The nozzles 108 may be arranged in a similar manner to the pressure chambers 110.

A plurality of apertures 112 may be formed in the flow-path unit 9. The apertures 112 may partially define ink flow paths from the sub-manifold flow paths 105*a* to the pressure chambers 110. The apertures 112 may be arranged in aperture rows 121*a* to 121*p* arrayed in parallel to the longitudinal direction of the flow-path unit 9. The aperture rows 121*a* to 121*d* may be formed to concentrate in a region in which the corresponding sub-manifold flow path 105*a* is positioned in plan view. Also, the aperture rows 121*e* to 121*h*, the aperture rows 121*i* to 121*l*, and the aperture rows 121*m* to 121*p*, may be respectively positioned to concentrate in regions in which the corresponding sub-manifold flow paths 105*a* are positioned in plan view.

Figure 5A:
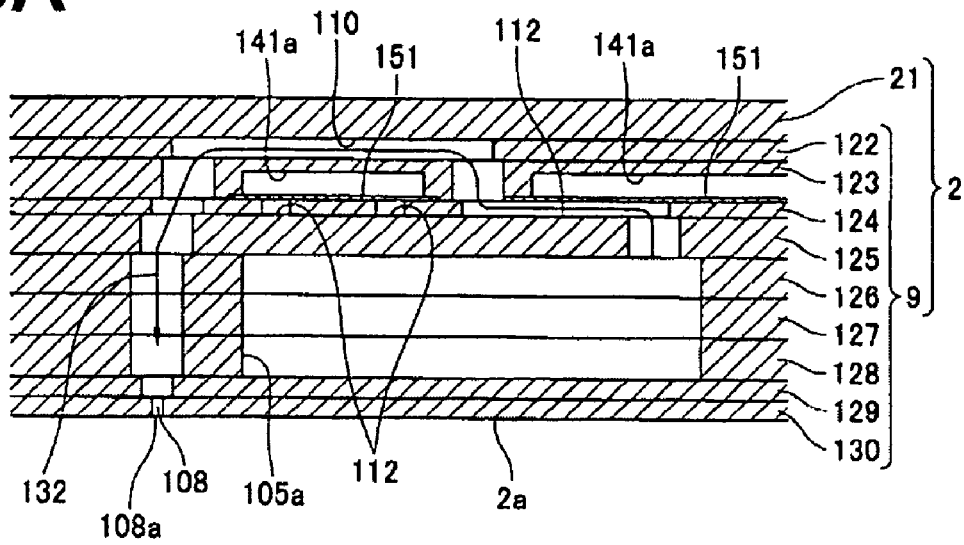
FIGS. 5A and 5B are cross-sectional views taken along the line IV-IV shown in FIG. 4.

Referring to FIG. 5A, the flow-path unit 9 may comprise a plurality of, e.g., nine, metal plates made of stainless steel and the like. The nine metal plates may be a cavity plate 122, a base plate 123, an aperture plate 124, a supply plate 125, manifold plates 126, 127, and 128, a cover plate 129, and a nozzle plate 130. The plates 122 to 130 may have rectangular surface shapes elongated in a main-scanning direction.

Multiple through holes corresponding to ink supply ports 105*b*, and multiple, substantially rhombic through holes corresponding to pressure chambers 110 may be formed in the cavity plate 122. A communication hole between a pressure chamber 110 and an aperture 112, a communication hole between the pressure chamber 110 and a nozzle 108, and a communication hole between an ink supply port 105*b* and a manifold flow path 105, may be formed for each pressure chamber 110 in the base plate 123. A through hole later serving as an aperture 112, a communication hole between a pressure chamber 110 and a nozzle 108, and a communication hole between an ink supply port 105*b* and a manifold flow path 105, may be formed for each pressure chamber 110 in the aperture plate 124. A communication hole between an aperture 112 and a sub-manifold flow path 105*a*, a communication hole between a pressure chamber 110 and a nozzle 108, and a communication hole between an ink supply port 105*b* and a manifold flow path 105, may be formed in the supply plate 125. Communication holes between a pressure chamber 110 and a nozzle 108, and through holes which are coupled with each other when being layered and later serve as a manifold flow path 105 and a sub-manifold flow path 105*a*, may be formed for each pressure chamber 110 in the manifold plates 126, 127, and 128. A communication hole between a pressure chamber 110 and a nozzle 108 may be formed for each pressure chamber 110 in the cover plate 129. A nozzle 108 corresponding to each pressure chamber 110 may be formed in the nozzle plate 130. An opening 108*a* of a nozzle 108 may be formed in a lower surface of the nozzle plate 130.

Multiple individual ink flow paths 132 may be formed by positioning and layering the plates 122 to 130. The individual ink flow paths 132 may extend from the manifold flow paths 105 to the sub-manifold flow paths 105*a*, and then extend from outlet ports of the sub-manifold flow paths 105*a*, through the apertures 112 and the pressure chambers 110, to the nozzles 108. The apertures 112 may have a smallest cross section in a direction orthogonal to an ink-flow direction of ink, i.e., direction in which the individual ink flow paths 132 extend, among components of the individual ink flow paths 132 except the nozzles 108.

Ink supplied from the reservoir unit 3 into the flow-path unit 9 through the ink supply port 105*b* may flow from the manifold flow path 105 and may be split into the sub-manifold flow paths 105*a*. The ink in the sub-manifold flow paths 105*a* may flow through the individual ink flow paths 132, and may reach the nozzles 108 through the apertures 112, which function as ink-limiting holes, and through the pressure chambers 110.

Referring to FIG. 3, the plurality of, e.g., four, actuator units 21 each may have a trapezoidal surface shape. The actuator units 21 may be arranged in a staggered manner so as not to interfere with the ink supply ports 105*b*. Parallel opposite sides of each actuator unit 21 may extend in the longitudinal direction of the flow-path unit 9. Facing oblique sides of the adjacent actuator units 21 may be overlapped with each other in a width direction of the flow-path unit 9, i.e. sub-scanning direction.

The actuator unit 21 may have a layered structure in which a plurality of piezoelectric sheets is layered. Each piezoelectric sheet may be configured of a ferroelectric material of lead zirconate titanate (PZT) ceramics. Each piezoelectric sheet may be a continuous plate having a size extending over a plurality of pressure chambers 110. Individual electrodes may be positioned on an upper surface of the piezoelectric sheet in a top layer, at positions opposing the pressure chambers 110. A common electrode may be positioned on a lower surface of the piezoelectric sheet in the top layer to cover the entire sheet.

A ground potential may be equally applied to all regions of the common electrode corresponding to the pressure chambers 110. Meanwhile, driving signals from the driver IC may be selectively input to the individual electrodes. That is, a portion interposed between the individual electrode and the pressure chamber 110 in the actuator unit 21 may serve as an individual actuator, i.e., ejection actuator. A plurality of actuators may be provided by a number corresponding to the number of pressure chambers 110.

The piezoelectric sheet may be polarized in a thickness direction thereof. A portion of the piezoelectric sheet opposing the individual electrode may serve as an active layer. When the individual electrode has a different potential from that of the common electrode, and when an electric field is applied to the piezoelectric sheet in a polarization direction, the electric-field applied portion of the piezoelectric sheet in the active layer may be deformed by a piezoelectric effect. For example, when the polarization direction is consistent with the electric-field application direction, the active portion may be contracted in a direction orthogonal to the polarization direction, i.e., in a plane direction. That is, the actuator unit 21 may be a so-called unimorph-type actuator, in which the piezoelectric sheet in the top layer serves as a layer containing the active portion, and in which the piezoelectric layer arranged below the top layer serves as an inactive layer. The piezoelectric sheets may be positioned on the upper surface of the cavity plate 122 which defines the pressure chambers 110. Therefore, if a deformation of the electric-field applied portion of the piezoelectric sheet in the top layer is not consistent with a deformation of a corresponding portion of the piezoelectric sheet arranged below the top layer, the piezoelectric sheets may be entirely deformed to bulge toward the pressure chamber 110, i.e., unimorph deformation. Therefore, a pressure may be applied to ink in the pressure chamber 110, and an ink droplet may be ejected from the nozzle 108. That is, the pressure chamber 110 may correspond to a region in which ejection energy for ejecting ink from the opening 108*a* is applied from the actuator unit 21 to the ink in the individual ink flow path 132.

Since the aperture 112 is arranged between the pressure chamber 110 and the sub-manifold flow path 105*a*, an ink-limiting effect may be provided in the individual ink flow path 132. Thus, when a pressure is applied to the pressure chamber 110, ink in the individual ink flow path 132 may easily flow to the nozzle 108 without flowing back to the sub-manifold flow path 105*a*. Also, when an ink droplet is ejected in a so-called fill-before-fire mode, a pressure wave generated when a negative pressure is applied to ink in the pressure chamber 110 may be reflected by the aperture 112. Then, a positive pressure may be applied to the ink in the pressure chamber 110 at timing when the reflected wave reaches the pressure chamber 110. As described above, the aperture 112 also may have a function of reflecting the pressure wave from the pressure chamber 110. After the ink droplet is ejected from the nozzle 108, the ink may be re-filled from the sub-manifold flow path 105*a* to the pressure chamber 110 through the aperture 112.

Referring to FIG. 3, the air flow path 141 may be formed in the flow-path unit 9. The air flow path 141 may be filled with the air. An opening 141*b* of the air flow path 141 may be formed in the upper surface of the flow-path unit 9. The opening 141*b* may communicate with the opening 3*f* of the reservoir unit 3. The air flow path 141 may be split into a plurality of branch paths 141*a* in a region in the flow-path unit 9. In this embodiment, while the air flow path 141 and the branch path 141*a* are filled with the air, these components may be filled with gas other than the air, and/or fluid other than the gas. For example, liquid may be injected in addition to gas.

FIG. 4 partially illustrates the branch paths 141*a*. The branch paths 141*a* may extend in parallel to the longitudinal direction of the flow-path unit 9. Each branch path 141*a* may be arranged to be overlapped with two adjacent aperture rows in plan view. For example, a branch path 141*a* may be overlapped with the aperture rows 121*i* and 121*j*, whereas another branch path 141*a* may be overlapped with the aperture rows 121*k* and 121*l*. The branch paths 141*a* may communicate with each other through a plurality of communicating flow paths 141*c*. Branch paths 141*a* may be formed for the aperture rows 121*a* to 121*d*, 121*e* to 121*h*, and 121*m* to 121*p* in a similar positional relationship.

Referring to FIG. 5A, the branch path 141*a* may be formed in the base plate 123 so as to be open at the lower surface of the base plate 123. A diaphragm 151 may be positioned between the branch path 141*a* and the aperture 112. The diaphragm 151 may be a thin film-like flexible member made of a resin material, a metal material, or the like. The diaphragm 151 may be more easily deformable than the other plates constituting the flow-path unit 9. The diaphragm 151 may have a shape to cover a region in which the branch path 141*a* is overlapped with the aperture 112 in plan view. The diaphragm 151 may be positioned between the base plate 123 and the aperture plate 124 so as to completely separate the space in the branch path 141*a* from the space in the aperture 112. Therefore, the diaphragm 151 may define a part of an inner wall surface of the aperture 112, and also may define a part of an inner wall surface of the branch path 141*a*. The branch path 141*a* opposes the aperture 112 with the diaphragm 151 interposed therebetween. The peripheral edge of the diaphragm 151 may be securely bonded to either or both of the base plate 123 and the aperture plate 124. Accordingly, even when the diaphragm 151 is deformed, the ink may be prevented from flowing from the aperture 112 to the branch path 141*a*, and the air may be prevented from flowing from the branch path 141*a* to the aperture 112.

Figure 5B:
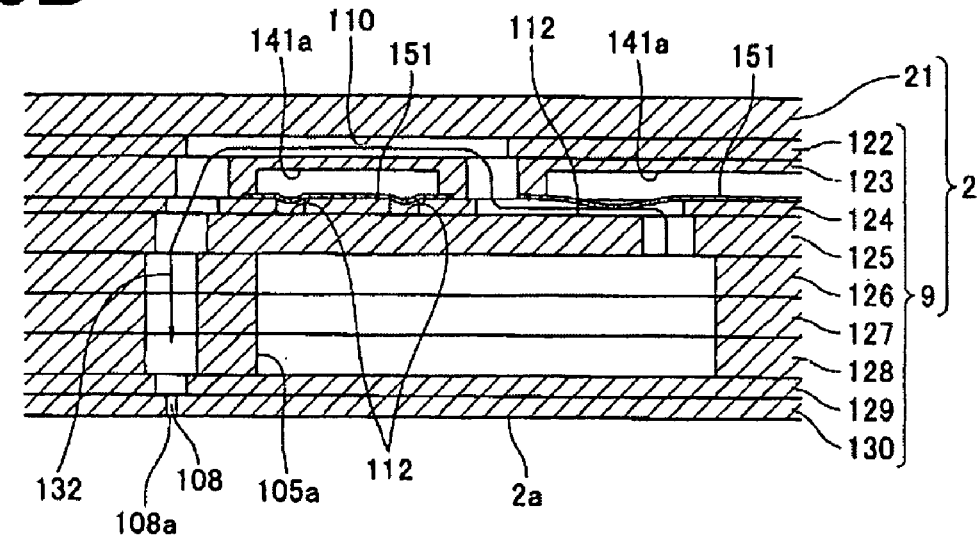

The diaphragm 151 may be deformed in accordance with the difference between the pressure in the branch path 141*a* and the pressure in the aperture 112. For example, when the pressure in the branch path 141*a* is equivalent to the pressure in the aperture 112, the diaphragm 151 may extend horizontally as shown in FIG. 5A. In contrast, when the pressure in the branch path 141*a* is higher than the pressure in the aperture 112, the diaphragm 151 is bent to bulge inward of the aperture 112 as shown in FIG. 5B. Therefore, the cross section of the aperture 112 in the state shown in FIG. 5B may be smaller than that in FIG. 5A in a direction orthogonal to the ink-flow direction, i.e., direction along the individual ink flow path 132. That is, the flow-path resistance of the aperture 112 in FIG. 5B may be higher than the flow-path resistance of the aperture 112 in FIG. 5A.

Meanwhile, after the ink is ejected from the nozzle 108 as described above, the ink may be re-filled from the sub-manifold flow path 105*a* to the pressure chamber 110 through the aperture 112. However, when the ink temperature flowing through the individual ink flow path 132 is changed, the performance of re-filling the ink from the sub-manifold flow path 105*a* to the pressure chamber 110 may be changed. This is because, when the ink temperature is changed, the ink viscosity may be changed accordingly. That is, as the ink temperature increases, the ink viscosity may decrease. The ink easily flows, and hence, the ink may be easily re-filled from the sub-manifold flow path 105*a* to the pressure chamber 110. In contrast, as the ink temperature decreases, the ink viscosity may increase. The ink slowly flows, and hence, the ink may be slowly re-filled from the sub-manifold flow path 105*a* to the pressure chamber 110.

In addition, the performance of re-filling the ink may be changed depending on the flow-path resistance of the aperture 112. The ink may slowly flow when the flow-path resistance is high, whereas the ink may easily flow when the flow-path resistance is low. For example, it may be assumed that the shape and size of the aperture 112 is determined such that the flow-path resistance of the aperture 112 is held at a predetermined value. Herein, it may also be assumed that the value of the flow-path resistance is adjusted such that the ink is re-filled by a suitable amount when the ink is at a certain temperature. In this case, when the ink is at a temperature higher than the certain temperature, the ink viscosity may decrease, and the ink may easily flow. Therefore, the re-filled amount may become excessive. In contrast, when the ink becomes at a temperature lower than the certain temperature, the ink viscosity may increase, and the ink may slowly flow. Therefore, the re-filled amount may become insufficient.

Referring to FIG. 2, the pressure controller 17 may control the pump 33 as follows. The pressure controller 17 may store control data in which the control amount of the pump 33 is associated with the value of the ink temperature. Then, the pressure controller 17 may acquire the control amount of the pump 33 corresponding to the ink temperature from the control data based on the detection result of the temperature sensor 18. The pressure controller 17 may control the pump 33 based on the acquired control amount, to change the pressure in the air flow path 141. Meanwhile, when the pump 33 changes the pressure in the air flow path 141, the pressure in the branch path 141*a* may be also changed. With the change, the diaphragm 151 may be deformed as shown in FIG. 5B. Therefore, the aperture 112 may be deformed, and the flow-path resistance of the aperture 112 may be changed.

Herein, the above-described control data may be adjusted such that the pressure in the air flow path 141 increases by way of the pump 33 as the ink temperature increases. In particular, the control data may be adjusted such that, as the ink temperature increases, the diaphragm 151 is deformed by the pressure in the branch path 141*a*, and the flow-path resistance of the aperture 112 increases. The flow-path resistance of the aperture 112 may be changed such that the performance of re-filling the ink from the sub-manifold flow path 105*a* to the pressure chamber 110 is constant regardless of the change in ink temperature.

In this embodiment, it may be expected that the pressure in the branch path 141*a* increases in accordance with the ink temperature. In this case, the pressure may be continuously changed, or may be changed stepwise, in accordance with the ink temperature. When the pressure is changed stepwise, the number of steps may be two, three, or more.

Therefore, when the ink temperature is high and the ink viscosity is low, the pressure controller 17 may control the pump 33 such that the ink easily flows and the flow-path resistance of the aperture 112 increases. In contrast, when the ink temperature is low and the ink viscosity is high, the pressure controller 17 may control the pump 33 such that the ink slowly flows and the flow-path resistance of the aperture 112 decreases. As described above, with this embodiment, the control may be executed such that the performance of re-filling the ink from the sub-manifold flow path 105*a* to the pressure chamber 110 is hardly changed regardless of the change in ink temperature.

In this embodiment, it may be expected that the diaphragm 151 is bent to bulge inward of the aperture 112 by increasing the pressure in the air flow path 141. However, the diaphragm 151 may be bent to bulge inward of the branch path 141*a* by reducing the pressure in the air flow path 141. In this case, the pump 33 may be controlled such that the diaphragm 151 is bent more largely as the ink temperature decreases.

Now, another embodiment of the present invention is described. Note that description of components in this embodiment similar to that in the above-described embodiment may be omitted. Also, numerals for description in this embodiment similar to those in the above described embodiment may refer similar components.

Figure 6:
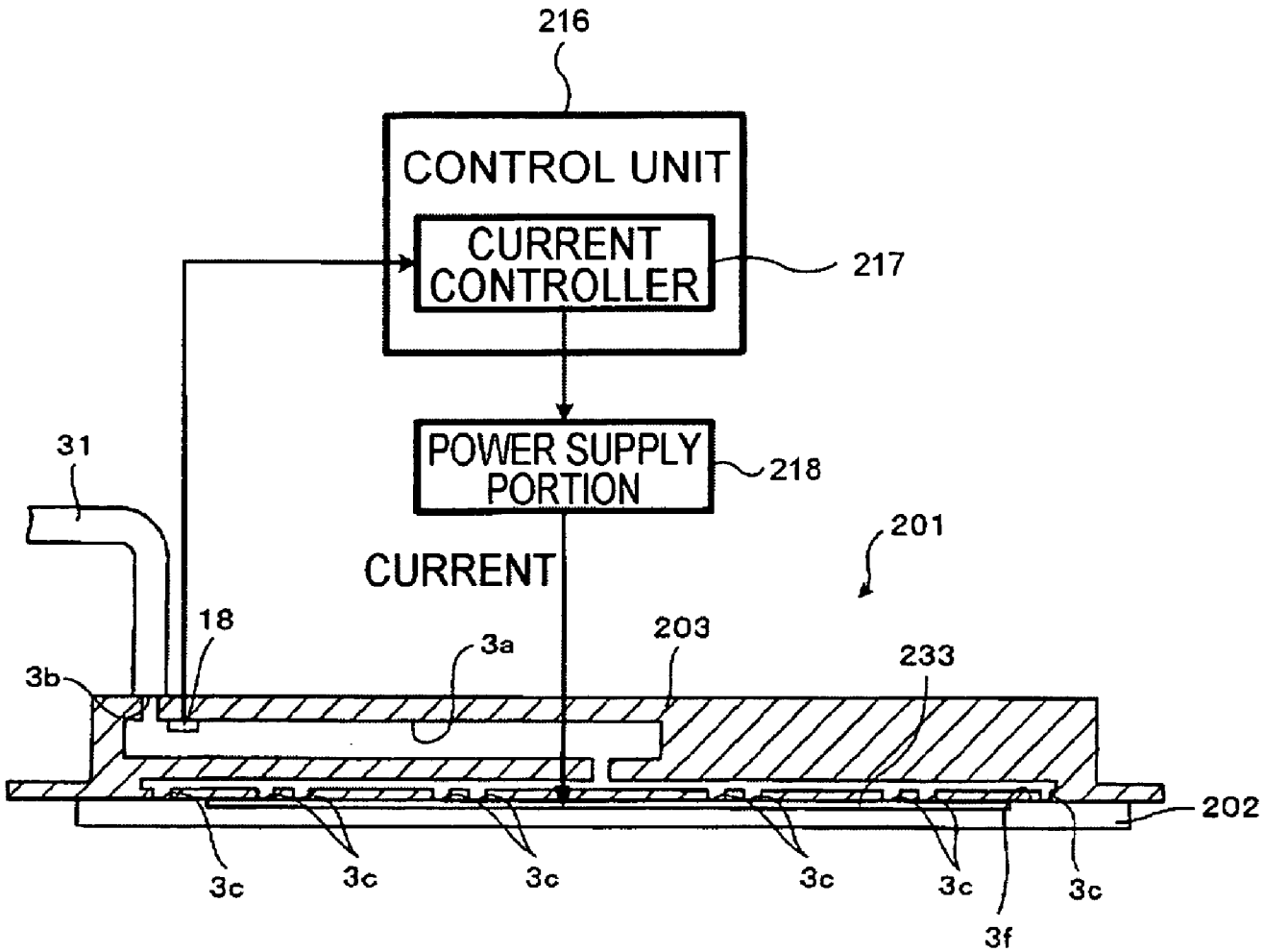
FIG. 6 is a side view including a partial cross-sectional view of an inkjet head according to another embodiment.

Referring to FIG. 6, an inkjet head 201 may comprise a reservoir unit 203 and a head body 202. The reservoir unit 203 may comprise the ink flow path 3*a* similarly to the reservoir unit 3, however, may not comprise an air flow path. Also, the temperature sensor 18 may be provided in the ink flow path 3*a*. The detection result of the temperature sensor 18 may be transmitted to a control unit 216. The inkjet head 201 may comprise an electromagnet 233 and a power supply portion 218 which supplies current to the electromagnet 233. The electromagnet 233 may be positioned on an upper surface of the head body 202. The power supply portion 218 may be able to allow current to flow to the electromagnet 233, or inhibit current from flowing to the electromagnet 233. The power supply portion 218 may be able to adjust the current amount to flow to the electromagnet 233. The control unit 216 may comprise a current controller 217 which controls the current of the power supply portion 218 to the electromagnet 233. The current controller 217 may control current supply of the power supply portion 218 to the electromagnet 233 based on the detection result of the temperature sensor 18.

Figure 7:
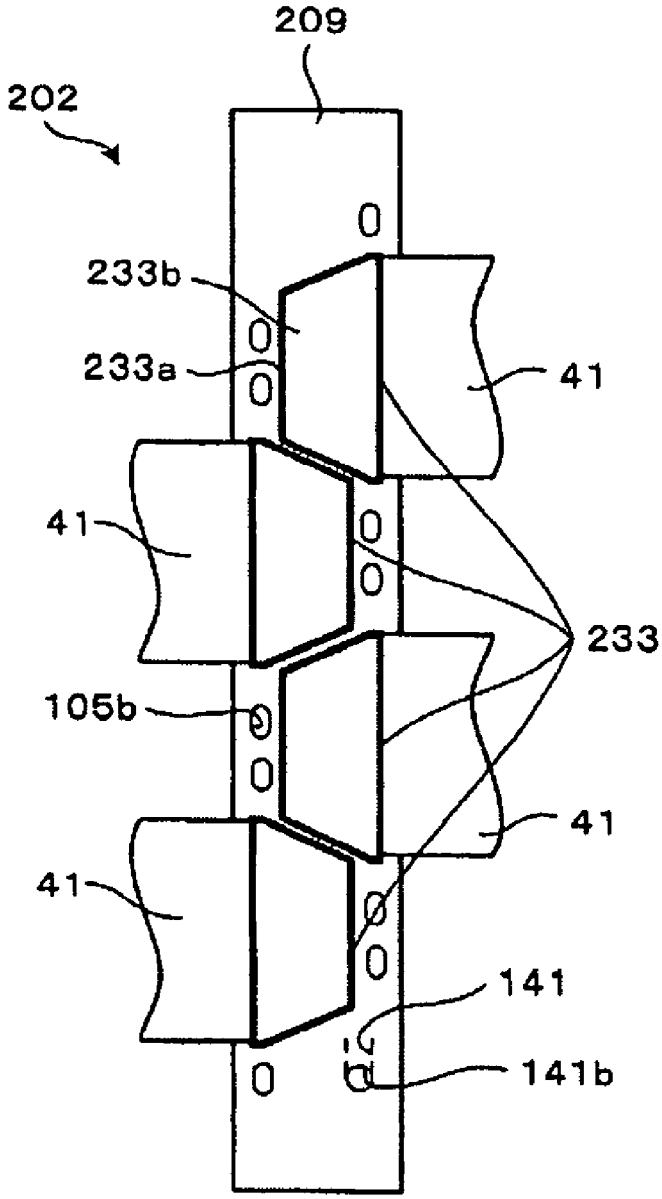
FIG. 7 is a plan view showing electromagnets and a head body in FIG. 6.

Referring to FIG. 7, the inkjet head 201 may comprise a plurality of, e.g., four, electromagnets 233. Each electromagnet 233 may have a magnetic core 233*b* and a winding 233*a* wound around the magnetic core 233*b*. The magnetic core 233*b* may have a columnar shape having horizontal upper and lower surfaces. The shapes of the upper and lower surfaces of the magnetic core 233*b* may be equivalent to a surface shape of the actuator unit 21. The electromagnet 233 may be positioned above the head body 202 so as to be substantially overlapped with the actuator unit 21 in plan view. The flexible printed cable 41 may be connected to the upper surface of the actuator unit 21. The flexible printed cable 41 may supply a driving signal for driving the actuator unit 21. The electromagnet 233 may be positioned further above the flexible printed cable 41. When current flows through the winding 233*a*, a magnetic field may be generated so as to vertically penetrate through the magnetic core 233*b*.

Figure 8A:
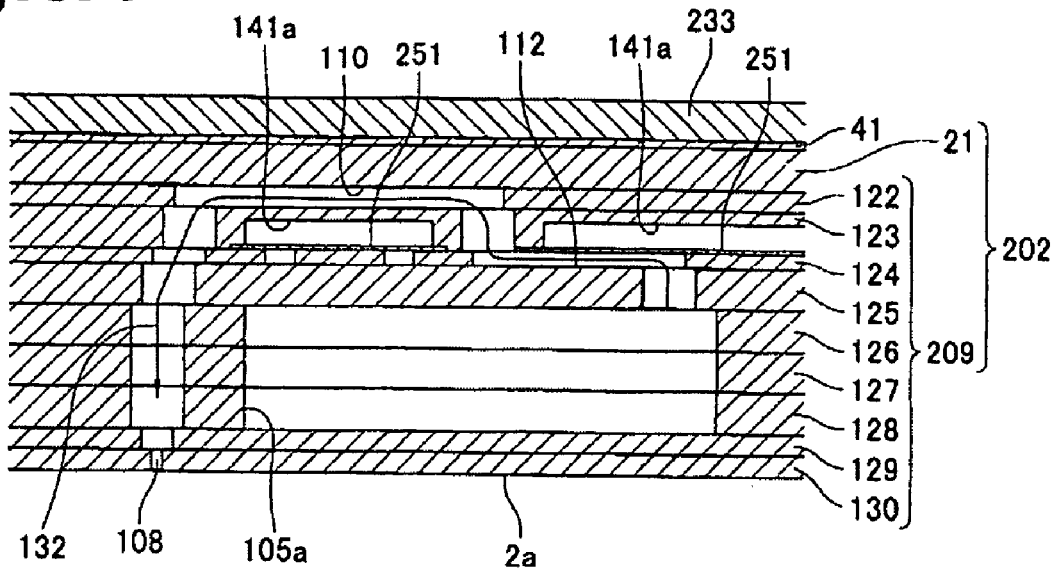
FIGS. 8A and 8B are cross-sectional views of a flow-path unit in FIG. 6, the figures respectively corresponding to FIGS. 5A and 5B.
Figure 8B:
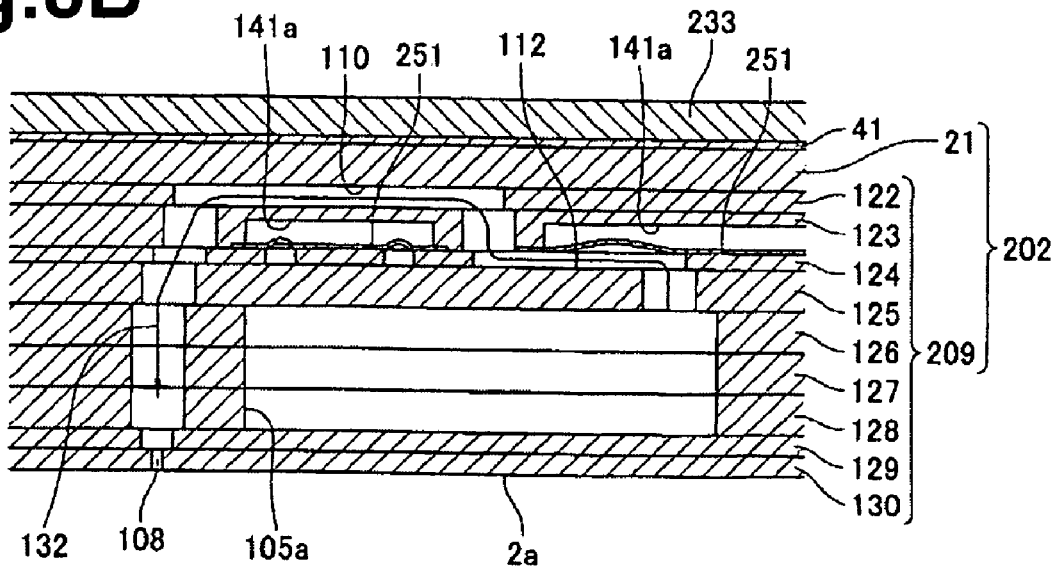

Referring to FIGS. 8A and 8B, the air flow path 141 and the branch path 141*a* may be formed in the base plate 123. However, the air flow path 141 may not communicate with a pump and the like, and may be exposed to the air. A diaphragm 251 may be positioned between the branch path 141*a* and the aperture 112. The shape, size, and arrangement of the diaphragm 251 may be similar to those of the diaphragm 151. However, the diaphragm 251 may be formed of a ferromagnetic material, for example, one selected from the SUS 400 series. On the other hand, other portions of the flow-path unit 209, such as the cavity plate 122 and the base plate 123 may be formed of a non-ferromagnetic material, such as one selected from the SUS 300 series.

Thus, when a magnetic field is generated as a result of current flowing to the electromagnet 233, the cavity plate 122 may not be magnetized, but the diaphragm 251 may be magnetized. The diaphragm 251 may be attracted upward to the electromagnet 233, and hence, the diaphragm 251 may be bent to bulge inward of the branch path 141*a* as shown in FIG. 8B. When no magnetic field is generated from the electromagnet 233, the diaphragm 251 may extend horizontally as shown in FIG. 8A.

The current controller 217 may store control data in which the current value of the current flowing to the electromagnet 233 is associated with the value of the ink temperature. Also, the current controller 217 may acquire the current value corresponding to the ink temperature from the control data based on the detection result of the temperature sensor 18. The current controller 217 may control the power supply portion 218 to supply the current to the electromagnet 233 by the acquired current value. Accordingly, the diaphragm 251 may be deformed as shown in FIG. 8B. Therefore, the aperture 112 may be deformed, and the flow-path resistance of the aperture 112 may be changed.

Herein, the above-described control data may be adjusted such that the current flowing to the electromagnet 233 increases as the ink temperature decreases. In particular, the control data may be adjusted such that, as the ink temperature decreases, the magnetic field from the electromagnet 233 becomes strong, thereby largely deforming the diaphragm 251, and hence, the flow-path resistance of the aperture 112 decreases. The flow-path resistance of the aperture 112 may be changed such that the performance of re-filling the ink from the sub-manifold flow path 105*a* to the pressure chamber 110 is constant regardless of the change in ink temperature.

Therefore, when the ink temperature is high and the ink viscosity is low, the current controller 217 may reduce the amount of the current flowing to the electromagnet 233, or stop the current supply such that the flow-path resistance of the aperture 112 increases. In contrast, when the ink temperature is low and the ink viscosity is high, the current controller 217 may increase the amount of the current flowing to the electromagnet 233, or resume the stopped current supply such that the flow-path resistance of the aperture 112 decreases. As described above, the control may be executed such that the performance of re-filling the ink from the sub-manifold flow path 105*a* to the pressure chamber 110 is hardly changed regardless of the change in ink temperature.

Now, still another embodiment of the present invention is described. Note that description of components in this embodiment similar to that in the above-described embodiments is omitted. Also, numerals for description in this embodiment similar to those in the above-described embodiments refer similar components.

Figure 9A:
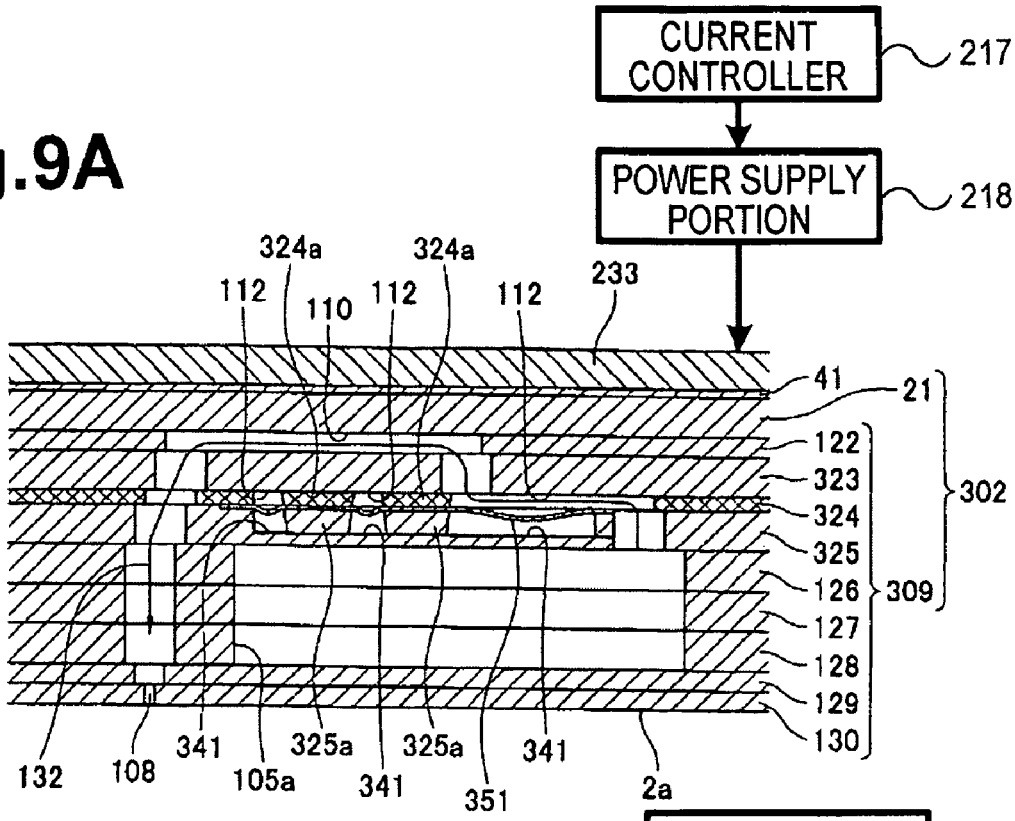
FIGS. 9A and 9B are cross-sectional views of a flow-path unit according to another embodiment, the figures respectively corresponding to FIGS. 5A and 5B of the embodiment.
Figure 9B:
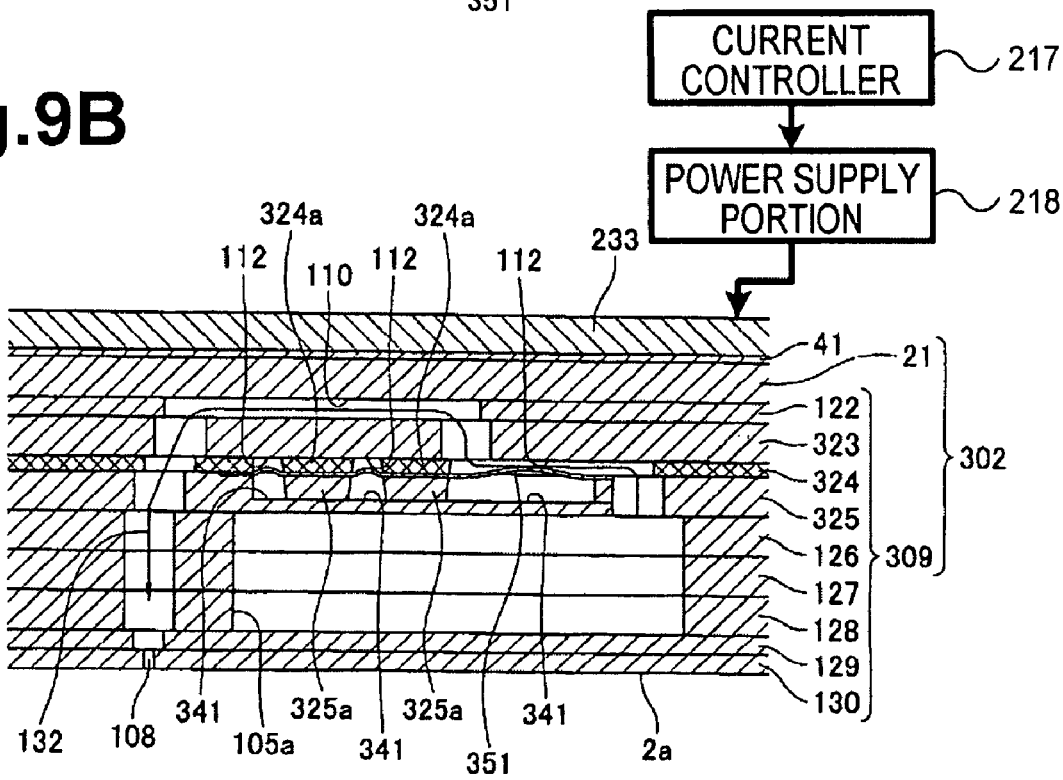

Referring to FIGS. 9A and 9B, a head body 302 of this embodiment may comprise a flow-path unit 309. 309A base plate 323 in the flow-path unit 309 may not have a configuration corresponding to the air flow path 141 or the branch path 141*a* of the above-described embodiment. However, an air chamber 341 may be formed in a supply plate 325 in this embodiment. Unlike the above-described embodiments, the air chamber 341 may not communicate with the outside of the flow-path unit 309, and may have a sealed space. The air chamber 341 may be positioned so as to be overlapped with each aperture 112 in plan view. Also, a rib 325*a* may be positioned between two adjacent apertures 112 in plan view.

A diaphragm 351 may be positioned between the air chamber 341 and the aperture 112. The diaphragm 351 may be a thin film-like flexible member made of a ferromagnetic material. The diaphragm 351 may be arranged to extend over a plurality of apertures 112. The diaphragm 351 may define a part of an inner wall surface of the aperture 112, and also define a part of an inner wall surface of the air chamber 341. The diaphragm 351 may completely separate the space in the air chamber 341 from the space in the aperture 112.

The flow-path unit 309 may be configured such that the diaphragm 351 is bent to bulge inward of the air chamber 341 when no magnetic field is generated from the electromagnet 233. An aperture plate 324 of the flow-path unit 309 may be made of a material having a smaller coefficient of expansion than that of a material of the supply plate 325. Thus, a rib 324*a* opposing the rib 325*a* with the diaphragm 351 interposed therebetween may be configured to have a smaller coefficient of linear expansion than that of the rib 325*a* in a left-right direction of FIGS. 9A and 9B. The ribs 324*a* and 325*a* may be designed so as to have equivalent widths in the left-right direction of FIGS. 9A and 9B at a certain temperature which is sufficiently higher than temperatures in an expected use environment of this embodiment. The ribs 324*a* and 325*a* may be bonded to each other at the certain temperature.

Accordingly, in the actual use environment, the rib 325*a* may be contracted more than the rib 324*a* in the left-right direction of FIGS. 9A and 9B. Due to this, a bending moment may be generated between the ribs 325*a* and 324*a*. The bending moment may be a moment which causes a region of the diaphragm 651 between the ribs 325*a* and 324*a* to be bent to bulge upward. The bending moment may act on regions of the diaphragm 351 adjacent to both ends of the ribs 324*a* and 325*a* to be bent to bulge downward. Hence, the diaphragm 351 may be bent to bulge inward of the air chamber 341 as shown in FIG. 9A.

The pressure in the air chamber 341 may be adjusted to be equivalent to or smaller than the pressure in the aperture 112 in the bent state. For example, when the diaphragm 351 is bent as shown in FIG. 9A, the aperture 112 and the air chamber 341 may be sealed to be the atmospheric pressure. When the diaphragm 351 is going to be bent inward of the aperture 112, the pressure in the air chamber 341 may decrease, and hence, a recovery force may act on the diaphragm 651 to be bent to bulge inward of the air chamber 341.

The flow-path unit 309 may be configured, as described above, such that the diaphragm 351 is bent to securely bulge downward when no magnetic field is generated from the electromagnet 233.

The current controller 217 may control the power supply portion 218 based on the detection result of the temperature sensor 18 such that the current flowing to the electromagnet 233 increases as the ink temperature increases. With this control, as shown in FIG. 9B, the diaphragm 351 may be bent to bulge inward of the aperture 112 as shown in FIG. 9B, thereby increasing the flow-path resistance of the aperture 112. The control may be executed such that the performance of re-filling the ink from the sub-manifold flow path 105*a* to the pressure chamber 110 is hardly changed regardless of the change in ink temperature.

Also, with this embodiment, when no magnetic field is generated from the electromagnet 233, the diaphragm 651 may be bent to bulge inward of the air chamber 341 as shown in FIG. 9A. When the magnetic field is generated from the electromagnet 233, the diaphragm 351 may be able to be bent to bulge inward of the aperture 112. Accordingly, the diaphragm 351 may be able to be deformed largely. The flow-path resistance of the aperture 112 may be able to be largely changed.

The present invention is not limited to the above-described embodiments, and various modifications can be made within the scope of the invention.

For example, in any of the above-described embodiments, the diaphragm for deforming the individual ink flow path 132 may be arranged to define the inner wall surface of the aperture 112. However, the diaphragm may be arranged at any position as long as the diaphragm is arranged between the pressure chamber 110 and the sub-manifold flow path 105*a*.

In any of the above-described embodiments, while the temperature sensor 18 may be disposed in the ink flow path 3*a* of the reservoir unit 3, the temperature sensor 18 may be disposed in an ink flow path in the flow-path unit.

In the above-described embodiments, it may be expected that the current to be supplied to the electromagnet 233 is changed in accordance with the ink temperature. In this case, the current may be continuously changed, or may be changed stepwise, in accordance with the ink temperature. When the current is changed stepwise, the number of steps may be two, three, or more. For example, the control may be executed such that a state in which no current is supplied to the electromagnet 233 and a state in which constant current is supplied to the electromagnet 233 are switched based on whether the ink temperature exceeds a certain temperature or not.

Now, still another embodiment of the present invention is described. Note that description of components in this embodiment similar to that in the above-described embodiments is omitted. Also, numerals for description in this embodiment similar to those in the above-described embodiments refer similar components.

Figure 10:
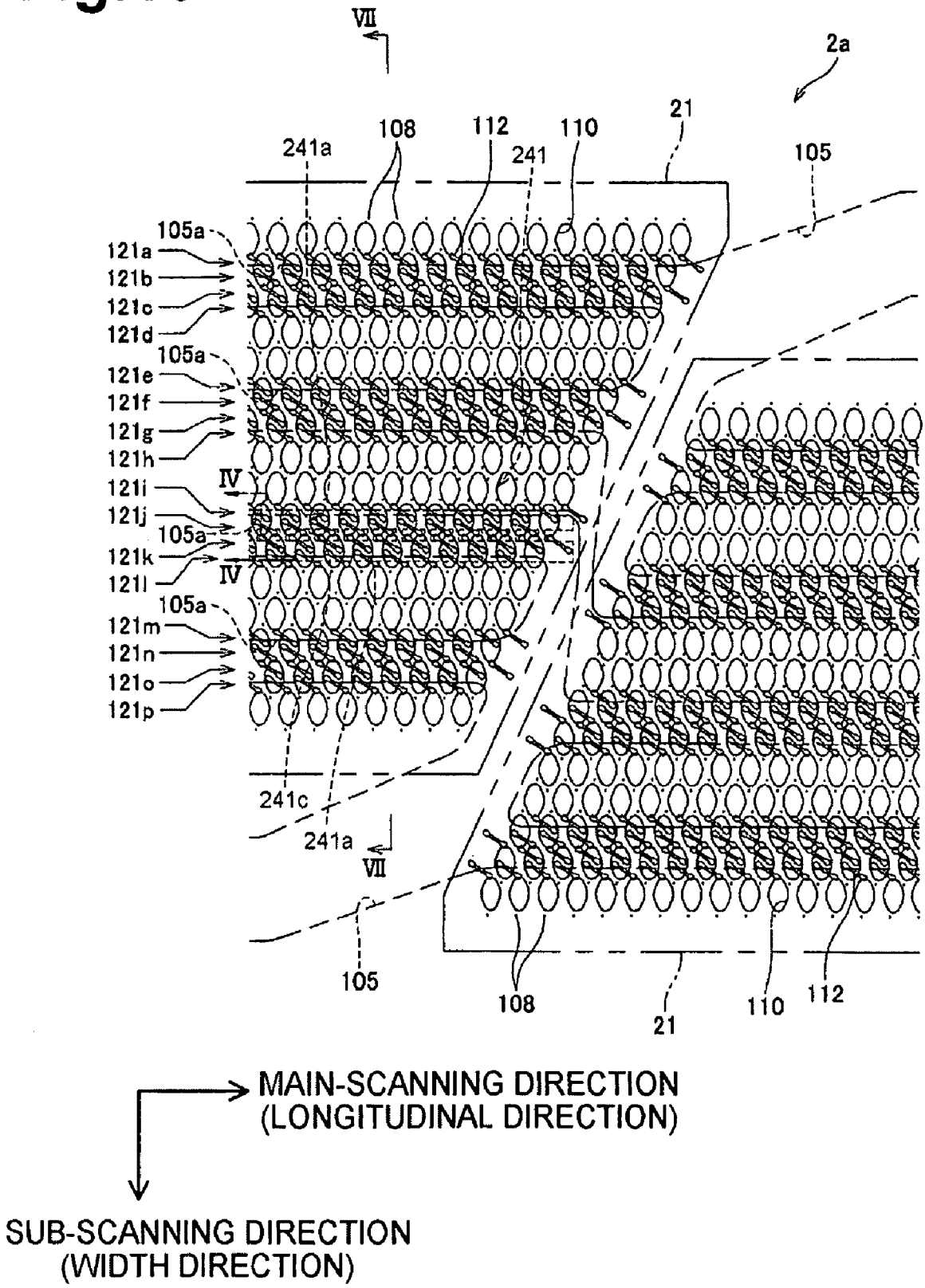
FIG. 10 is an enlarged view of a region surrounded by a dotted line in FIG. 3 according to another embodiment.

Referring to FIG. 10, an air chamber 241 may be formed in the flow-path unit 9. The air chamber 241 may define a sealed space in the flow-path unit 9. The air chamber 241 may be filled with the air. Gas to be filled into the air chamber 241 is not limited to the air, and may be mixture gas or pure gas. The air chamber 241 may comprise a plurality of sub-chambers 241*a*. The sub-chambers 241*a* may extend in parallel to the longitudinal direction of the flow-path unit 9. Each sub-chamber 241*a* may be arranged to be overlapped with a plurality of, e.g., two, adjacent aperture rows in plan view. For example, a sub-chamber 241*a* may be overlapped with the aperture rows 121*i* and 121*j*, whereas another sub-chamber 241*a* may be overlapped with the aperture rows 121*k* and 121*l*. The sub-chambers 241*a* may communicate with each other through a plurality of communicating flow paths 241*c*. Sub-chambers 241*a* may be formed for the aperture rows 121*a* to 121*d*, 121*e* to 121*h*, and 121*m* to 121*p* in a similar positional relationship.

Figure 11:
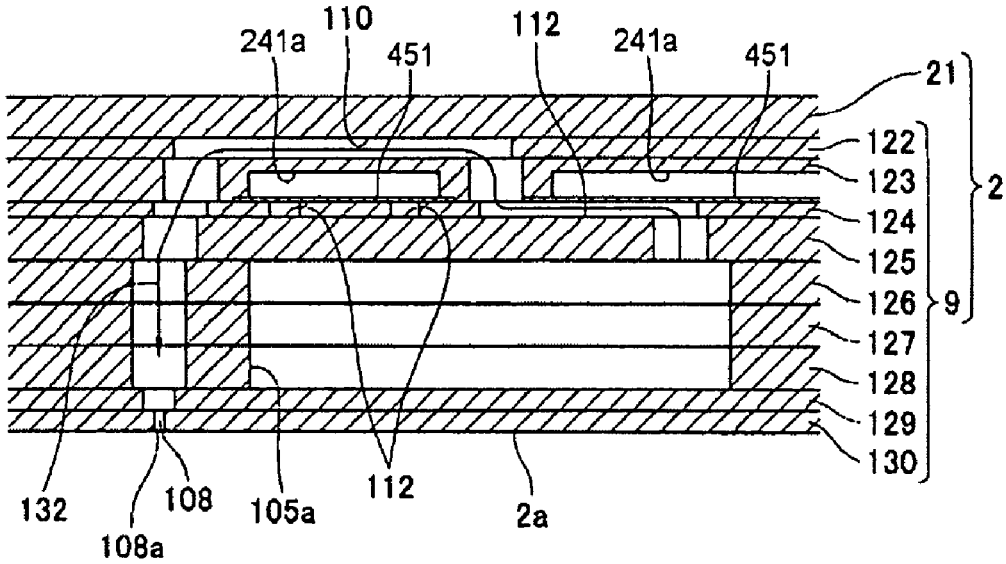
FIG. 11 is a cross-sectional view taken along the line VII-VII shown in FIG. 10.

Referring to FIG. 11, the sub-chambers 241*a* may be formed in the base plate 123, and may be open at the lower surface of the base plate 123. A diaphragm 451 may be provided between the sub-chamber 241*a* and the aperture 112. The diaphragm 451 may be a thin film-like flexible member made of a resin material, a metal material, or the like. The diaphragm 451 may be more easily deformable than the other plates constituting the flow-path unit 9. The diaphragm 451 may have a shape to cover a region in which the sub-chamber 241*a* is overlapped with the aperture 112 in plan view. The diaphragm 451 may be positioned between the base plate 123 and the aperture plate 124 so as to completely separate the space in the sub-chamber 241*a* from the space in the aperture 112. The diaphragm 451 may define a part of an inner wall surface of the aperture 112, and may also define a part of an inner wall surface of the sub-chamber 241*a*. The sub-chamber 241*a* faces the aperture 112 with the diaphragm 451 interposed therebetween. The peripheral edge of the diaphragm 451 may be securely bonded to either or both of the base plate 123 and the aperture plate 124. Accordingly, even when the diaphragm 451 is deformed, the ink may be prevented from flowing from the aperture 112 to the sub-chamber 241*a*, and the air may be prevented from flowing from the sub-chamber 241*a* to the aperture 112.

After the ink is ejected from the nozzle 108 as described above, the ink may be re-filled from the sub-manifold flow path 105*a* to the pressure chamber 110 through the aperture 112. However, when the ink temperature flowing through the individual ink flow path 132 is changed, the performance of re-filling the ink from the sub-manifold flow path 105*a* to the pressure chamber 110 may be changed. This is because, when the ink temperature is changed, the ink viscosity is changed accordingly. That is, as the ink temperature increases, the ink viscosity may decrease. The ink easily flows, and hence, the ink may be easily re-filled from the sub-manifold flow path 105*a* to the pressure chamber 110. In contrast, as the ink temperature decreases, the ink viscosity may increase. The ink slowly flows, and hence, the ink may be slowly re-filled from the sub-manifold flow path 105*a* to the pressure chamber 110.

In addition, the performance of re-filling the ink may be changed depending on the flow-path resistance of the aperture 112. The ink may slowly flow when the flow-path resistance is high, whereas the ink may easily flow when the flow-path resistance is low. For example, it may be assumed that the shape and size of the aperture 112 is determined such that the flow-path resistance of the aperture 112 is held at a predetermined value. Herein, it may also be assumed that the value of the flow-path resistance is adjusted such that the ink is re-filled by a suitable amount when the ink is at a certain temperature. In this case, when the ink is at a temperature higher than the certain temperature, the ink viscosity may decrease, and the ink may easily flow. Hence, the re-filled amount may become excessive. In contrast, when the ink becomes at a temperature lower than the certain temperature, the ink viscosity may increase, and the ink may slowly flow. Hence, the re-filled amount may become insufficient.

Hence, the air chamber 241 and the diaphragm 451 may be configured such that the flow-path resistance of the aperture 112 is appropriately changed in accordance with the temperature of the ink in the individual ink flow path 132. In particular, the air chamber 241 may be sealed in the flow-path unit 9 as described above. Thus, the pressure in the air chamber 241 may be changed in accordance with the ink temperature.

Figure 12A:
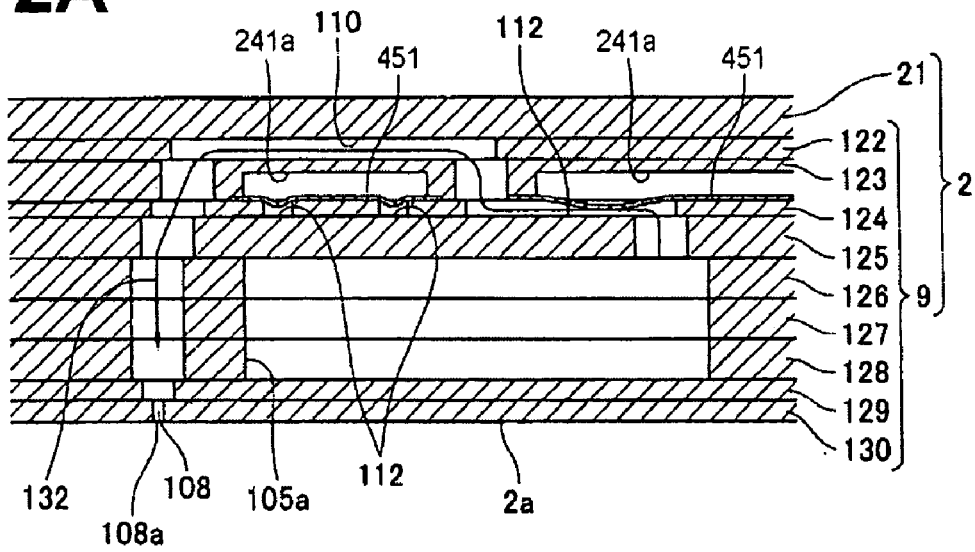
FIGS. 12A and 12B illustrate states in which a diaphragm is deformed.

The diaphragm 451 may be deformed in accordance with the difference between the pressure in the sub-chamber 241*a* and the pressure in the aperture 112. For example, when the pressure in the sub-chamber 241*a* is equivalent to the pressure in the aperture 112, the diaphragm 451 may extend horizontally as shown in FIG. 11. In contrast, when the pressure in the sub-chamber 241*a* is higher than the pressure in the aperture 112, the diaphragm 451 may be bent to bulge inward of the aperture 112 as shown in FIG. 12A. Hence, in the state shown in FIG. 12A, the cross section of the aperture 112 may be smaller than that in FIG. 11 in a direction orthogonal to the ink-flow direction, i.e., direction along the individual ink flow path 132. That is, the flow-path resistance of the aperture 112 in FIG. 12A may be higher than the flow-path resistance of the aperture 112 in FIG. 11.

Figure 12B:
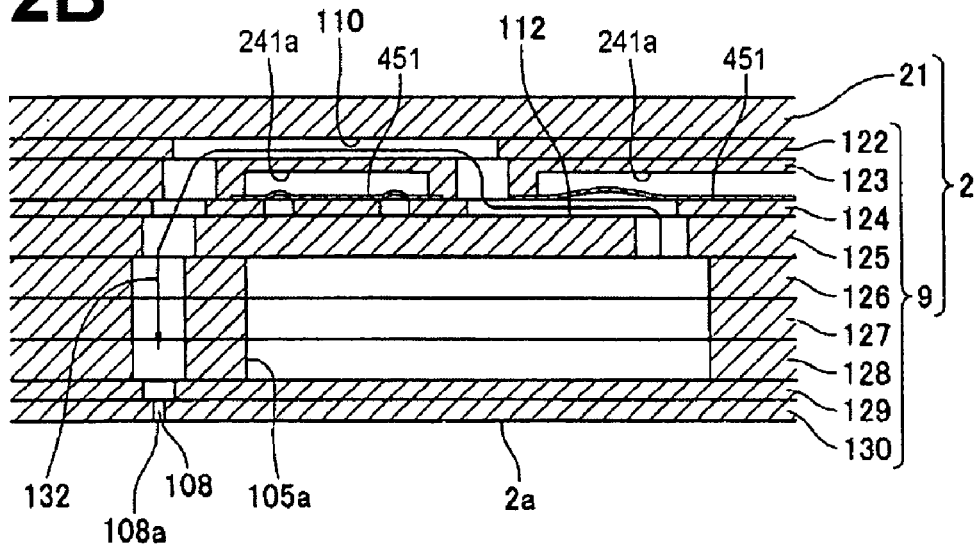

In contrast, when the pressure in the sub-chamber 241*a* is lower than the pressure in the aperture 112, the diaphragm 451 may be bent to bulge inward of the sub-chamber 241*a* as shown in FIG. 12B. Hence, in the state shown in FIG. 12B, the cross section of the aperture 112 may be larger than that in FIG. 11 in the direction orthogonal to the ink-flow direction. That is, the flow-path resistance of the aperture 112 in FIG. 12B may be lower than the flow-path resistance of the aperture 112 in FIG. 11.

The air in the sub-chamber 241*a* may be adjusted such that the diaphragm 451 extends horizontally as shown in FIG. 11 at a certain temperature. When the temperature of the air increases, the diaphragm 451 may be bent to bulge inward of the aperture 112. Hence, the flow-path resistance in the aperture 112 may increase. In contrast, when the temperature of the air decreases, the diaphragm 451 may be bent to bulge inward of the sub-chamber 241*a*. Hence, the flow-path resistance in the aperture 112 may decrease.

As described above, with this embodiment, the diaphragm 451 may be deformed such that the cross section of the aperture 112 decreases as the temperature of the ink in the individual ink flow path 132 increases. Also, the diaphragm 451 may be deformed such that the cross section of the aperture 112 increases as the temperature of the ink in the individual ink flow path 132 decreases. That is, since the ink in the individual ink flow path 132 easily flows when the ink temperature is high and the ink viscosity is low, the diaphragm 451 may be deformed in an increase direction of the flow-path resistance of the aperture 112. In contrast, since the ink in the individual ink flow path 132 slowly flows when the ink temperature is low and the ink viscosity is high, the diaphragm 451 may be deformed in a decrease direction of the flow-path resistance of the aperture 112. Thus, this embodiment may be configured such that the performance of re-filling the ink from the sub-manifold flow path 105*a* to the pressure chamber 110 is hardly changed regardless of the ink temperature.

The deformation amount of the diaphragm 451 in accordance with the change in ink temperature may depend on design parameters, such as the material, thickness, and surface shape of the diaphragm 451, and the mass of gas filled in the air chamber 241. The deformation amount of the diaphragm 451 may be able to be adjusted by adjusting the parameters. Note that a step of filling gas into the air chamber 241 by a predetermined mass may be as follows. For example, a flow path communicating with the air chamber 241 may be formed in a manufacturing process of the flow-path unit 9. Gas is introduced into the air chamber 241 through the flow path while a predetermined pressure corresponding to the volume of the air chamber 241 and the predetermined mass is applied to the gas. Then, the flow path may be sealed.

The deformation amount of the diaphragm 451 may be adjusted such that the performance of re-filling the ink in the individual ink flow path 132 is minimally changed even when the ink temperature is changed. The performance of re-filling may be as constant as possible within a temperature range, e.g., in a range of from about 5° C. to 40° C., which is expected as a use environment of the inkjet printer 101 of this embodiment. If the flow-path unit 9 is configured to have a wide temperature range in which the performance of re-filling the ink is not changed, the temperature range expected as the use environment of the inkjet printer 101 may be set wide accordingly.

In the above-described embodiment, it may be expected that the diaphragm 451 is bent to bulge inward of the sub-chamber 241*a* when the ink temperature is low, whereas the diaphragm 451 is bent to bulge inward of the aperture 112 when the ink temperature is high. However, the diaphragm 451 may not have to be shifted from the state (FIG. 12B) in which the diaphragm 451 is bent to bulge inward of the sub-chamber 241*a* to the state (FIG. 12A) in which the diaphragm 451 is bent to bulge inward of the aperture 112, within the temperature range expected as the use environment of the first embodiment. For example, the diaphragm 451 may extend horizontally as shown in FIG. 11 when at the lowest temperature in the above-described temperature range, and the diaphragm 451 may be bent to bulge inward of the aperture 112 as the ink temperature increases. Alternatively, the diaphragm 451 may be bent to bulge inward of the sub-chamber 241*a* at the highest temperature and the lowest temperature in the above-described temperature range, and the bending amount of the diaphragm 451 may be set to become smaller as the ink temperature decreases within the temperature range.

Now, still another embodiment of the present invention is described. Note that description of components in this embodiment similar to that in the above-described embodiments is omitted. Also, numerals for description in this embodiment similar to those in the above-described embodiments refer similar components.

Figure 13:
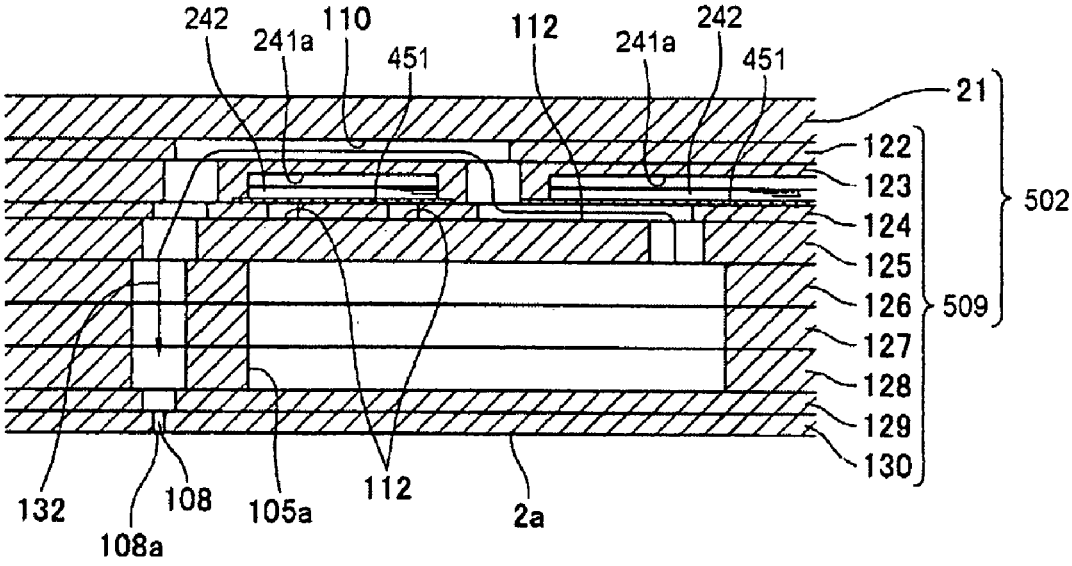
FIG. 13 is a cross-sectional view of a head body according to another embodiment.

Referring to FIG. 13, the head body 2 in the above-described embodiments may be replaced with the head body 502. The head body 502 may comprise a flow-path unit 509. The air chamber 241 in the flow-path unit 509 may be filled with liquid 242 in addition to gas. The gas in the air chamber 241 and the liquid 242 may be selected such that the amount of the gas to be dissolved into the liquid 242 decreases as the temperature increases in a temperature range expected as a use environment of this embodiment. For example, the liquid 242 may be water, and the gas in the air chamber 241 may be carbon dioxide. The amount of the gas in the air chamber 241 and the amount of the liquid 242 may be adjusted such that the pressure in the air chamber 241 increases when the ink temperature in the individual ink flow path 132 increases within the above-described temperature range. Adjustment may be made for deforming the diaphragm 451 such that the cross section of the aperture 112 decreases as the ink temperature increases.

The deformation amount of the diaphragm 451 may be able to be adjusted with this embodiment while a phenomenon is used in which the amount of the gas to be dissolved into the liquid 242 is changed in accordance with the temperature. Accordingly, the degree of freedom of design for adjusting the deformation amount of the diaphragm 451 may increase. Also, the deformation of the diaphragm 451 in accordance with the change in temperature may be able to be easily adjusted as compared with the case in which the thermal expansion of the wall portion of the ink flow path is used.

Now, still another embodiment of the present invention is described. Note that description of components in this embodiment similar to that in the above-described embodiments is omitted. Also, numerals for description in this embodiment similar to those in the above-described embodiments refer similar components.

Figure 14A:
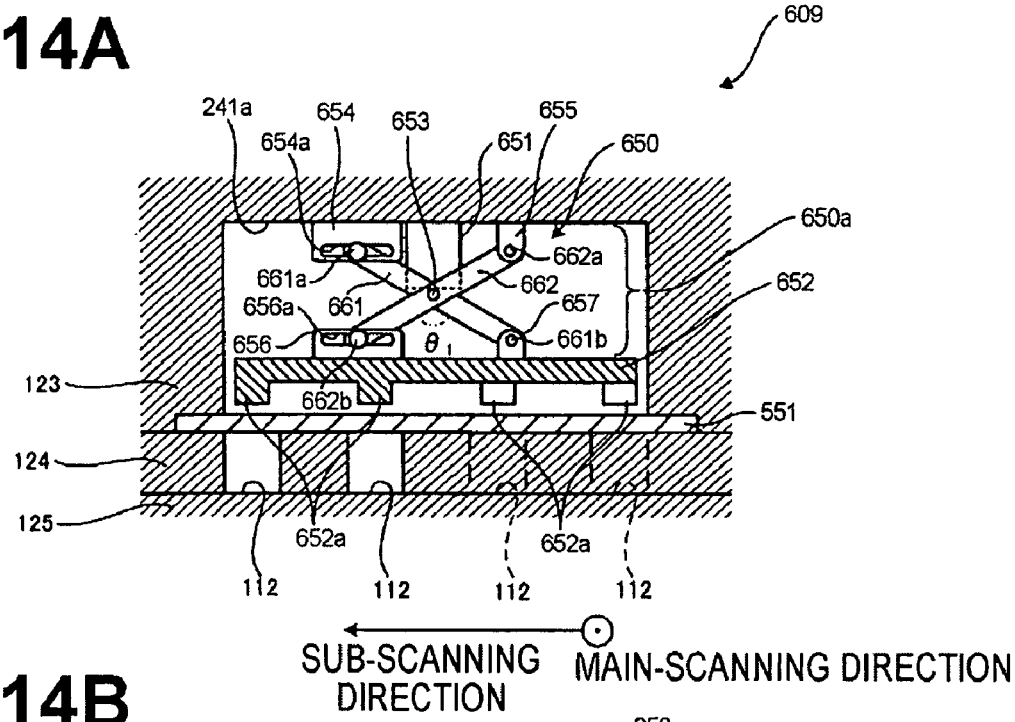
FIGS. 14A and 14B are cross-sectional views of a head body according to another embodiment, FIGS. 14A and 14B each corresponding to a cross section taken along the line VII-VII in FIG. 3.
Figure 14B:
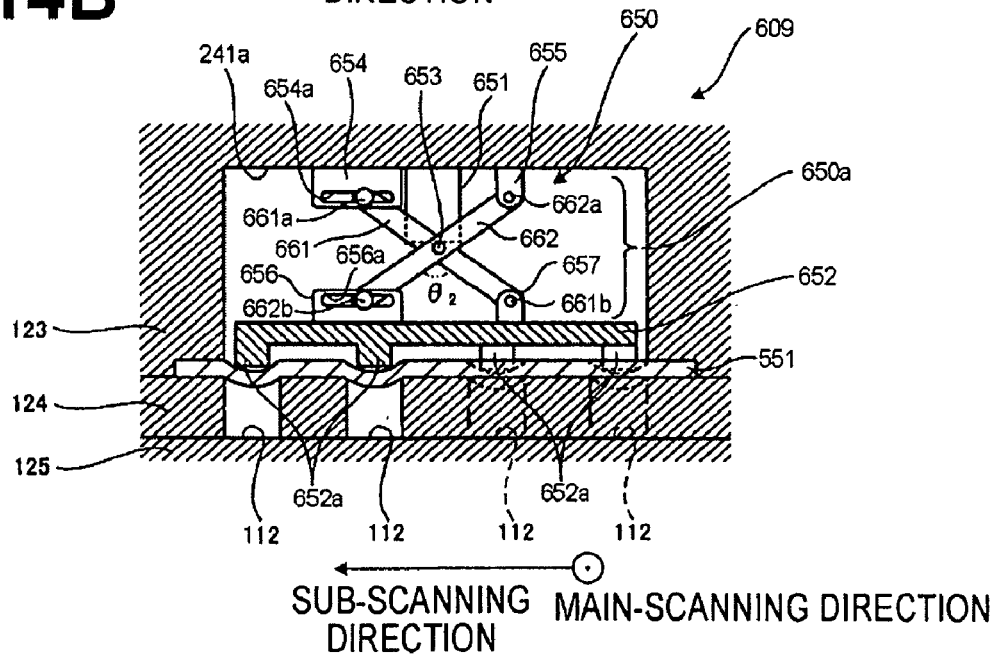

Referring to FIGS. 14A and 14B, the flow-path unit 9 in the above-described embodiments may be replaced with the flow-path unit 609. In the flow-path unit 609, a diaphragm biasing member 650 may be provided in the sub-chamber 241*a*. The diaphragm biasing member 650 may comprise a plate member 652 extending along the diaphragm 551. A plurality of protrusions 652*a* may be positioned on a lower surface of the plate member 652 so as to protrude downward. Each protrusion 652*a* may oppose the aperture 112 with the diaphragm 551 interposed therebetween.

The diaphragm biasing member 650 may comprise a thermally deformable member 651. The thermally deformable member 651 may be fixed to a ceiling surface of the sub-chamber 241*a*. The thermally deformable member 651 may be positioned where an arm member 661 is interposed between the thermally deformable member 651 and an arm member 662 in the main-scanning direction, i.e., direction from the back side to the front side in FIGS. 14A and 14B. The thermally deformable member 651 may be thermally expanded downward in accordance with the temperature of the ink in the aperture 112. The thermally deformable member 651 may be made of a material having a larger coefficient of linear expansion than that of a material for portions other than the thermally deformable member 651 in the flow-path unit 609. For example, the thermally deformable member 651 may be made of a material having a larger coefficient of linear expansion than that of the base plate 123 or that of the aperture plate 124.

The diaphragm biasing member 650 may comprise a displacement increasing mechanism 650*a* which displaces the plate member 652 more largely than the deformation amount of the thermally deformable member 651 by the thermal expansion. The displacement increasing mechanism 650*a* may comprise arm members 661 and 662. The arm members 661 and 662 may have equivalent lengths. The arm members 661 and 662 may intersect with each other in an overlapped manner in the main-scanning direction. The intersection position may be at a middle position in each length direction. The arm members 661 and 662 may be supported by a supporting shaft 653 at the intersection position. The supporting shaft 653 may be a shaft member extending in the main-scanning direction. The supporting shaft 653 may support the arm members 661 and 662 mutually rotatably. Accordingly, the arm members 661 and 662 can mutually rotate clockwise or counterclockwise around the supporting shaft 653 as a rotation axis as shown in FIGS. 14A and 14B. The supporting shaft 653 may extend to a position below the thermally deformable member 651 which is located at the back side of the arm member 662 in the main-scanning direction. A lower surface of the thermally deformable member 651 may be positioned to contact the supporting shaft 653 from the upper side.

Upper end portions of the arm members 661 and 662 may be supported by supporting members 654 and 655. The supporting member 654 may be a plate-shaped member extending in the vertical direction and the sub-scanning direction. The supporting member 654 may have a rectangular shape elongated in the sub-scanning direction. The supporting member 654 may be fixed to the ceiling surface of the sub-chamber 241*a*. The supporting member 654 may comprise a through hole 654*a* formed therein to extend in the sub-scanning direction. The upper end portion of the arm member 661 may be supported by the supporting member 654 via a clamp 661*a*. The clamp 661*a* may penetrate through the through hole 654*a* in a thickness direction of the supporting member 654. The clamp 661*a* may be able to move in a reciprocation manner in a direction in which the through hole 654*a* extends. Accordingly, the arm member 661 may be able to rotate around the clamp 661*a* as a rotation axis, and the upper end portion of the arm member 661 may be able to move in a reciprocation manner in the sub-scanning direction.

The supporting member 655 may have a plate-shaped and may be fixed to the ceiling surface of the sub-chamber 241*a*. The supporting member 655 may be positioned at the right side of the supporting member 654 as shown in FIGS. 14A and 14B. The upper end portion of the arm member 662 may be supported by the supporting member 655 via a shaft member 662*a*. The shaft member 662*a* may extend in the main-scanning direction. The arm member 662 may be supported by the supporting member 655 rotatably around the shaft member 662*a* as a rotation axis.

Lower end portions of the arm members 661 and 662 may be supported by supporting members 656 and 657. The supporting member 656 may be a plate-shaped member extending in the vertical direction and the sub-scanning direction. The supporting member 654 may have a rectangular shape elongated in the sub-scanning direction. The supporting member 656 may be fixed to an upper surface of the plate member 652. The supporting member 656 may have a through hole 656*a* formed therein to extend in the sub-scanning direction. The lower end portion of the arm member 662 may be supported by the supporting member 656 via a clamp 662*b*. The clamp 662*b* may penetrate through the through hole 656*a* in a thickness direction of the supporting member 656. The clamp 662*b* may be able to move in a reciprocation manner in a direction in which the through hole 656*a* extends. Accordingly, the arm member 662 may be able to rotate around the clamp 662*b* as a rotation axis, and the lower end portion of the arm member 662 may be able to move in a reciprocation manner in the sub-scanning direction.

The supporting member 657 may be a plate-like member and fixed to the upper surface of the plate member 652. The supporting member 657 may be positioned at the right side of the supporting member 656 as shown in FIGS. 14A and 14B. The lower end portion of the arm member 661 may be supported by the supporting member 657 via a shaft member 661*b*. The shaft member 661*b* may extend in parallel to the main-scanning direction. The arm member 661 may be supported by the supporting member 657 rotatably around the shaft member 661*b* as a rotation axis.

The displacement increasing mechanism 650*a* may increase the deformation amount of the thermally deformable member 651 by the thermal expansion, and may cause the plate member 652 to be displaced downward by a distance corresponding to the increased deformation amount. For example, FIG. 14A illustrates the thermally deformable member 651 when the temperature of the ink in the aperture 112 is at a certain value. When the ink temperature increases from this state, the thermally deformable member 651 may be thermally expanded downward, and may become the state shown in FIG. 14B. Hence, the supporting shaft 653 may be biased by the thermally deformable member 651, and may move downward accordingly. Then, the arm member 661 may rotate clockwise around the shaft member 661*b*, whereas the arm member 662 may rotate counterclockwise around the shaft member 662*a*. Thus, the arm members 661 and 662 may mutually rotate such that an angle defined between the arm members 661 and 662 is changed from 01 shown in FIG. 14A to θ2 (<θ1) shown in FIG. 14B. Further, the upper end portion of the arm member 661 may move rightward along the through hole 654*a*, whereas the lower end portion of the arm member 662 may move rightward along the through hole 656*a*.

The plate member 652 may move downward in parallel by a distance corresponding to a distance in which the lower end portions of the arm members 661 and 662 move downward. Herein, the lower end portions of the arm members 661 and 662 may move downward by a distance larger than a distance in which the lower surface of the thermally deformable member 651 moves downward. For example, the arm member 662 may rotate counterclockwise around the shaft member 662*a* from the state shown in FIG. 14A to the state shown in FIG. 14B. That is, the supporting shaft 653 and the clamp 662*b* may also rotate counterclockwise around the shaft member 662*a*. A distance in which the clamp 662*b* moves downward by the rotational movement may be larger than a distance in which the supporting shaft 653 moves downward. This is because the turning radius of the rotational movement of the clamp 662*b* may be larger than the turning radius of the rotational movement of the supporting shaft 653. Also, the distance in which the lower surface of the thermally deformable member 651 moves downward by the thermal expansion may be equivalent to the distance in which the supporting shaft 653 moves downward. Further, the distance in which the lower end portions of the arm members 661 and 662 move downward may be equivalent to the distance in which the plate member 652 moves downward. Hence, the plate member 652 may move downward by the distance larger than the deformation amount of the thermally deformable member 651 by the thermal expansion.

When the plate member 652 moves, each protrusion 652*a* positioned on the lower surface of the plate member 652 may move downward accordingly. That is, the biasing force of the thermally deformable member 651 by the thermal expansion may be transmitted to the protrusion 652*a* by the displacement increasing mechanism 650*a*. The protrusion 652*a* may contact the diaphragm 551, bias the diaphragm 551 downward, and cause the diaphragm 551 to be bent to bulge inward of the aperture 112. At this time, as the temperature of the ink in the aperture 112 increases, the thermally deformable member 651 may be thermally expanded more largely. Hence, as the ink temperature increases, the biasing force of the protrusion 652*a* to be applied to the diaphragm 551 may increase, and the diaphragm 551 may be bent more largely.

In contrast, when the temperature of the ink in the individual ink flow path 132 decreases from the state shown in FIG. 14B, the thermally deformable member 651 may be contracted upward. In this case, the biasing force applied from the thermally deformable member 651 to the supporting shaft 653 may decrease, and hence, the biasing force applied from the protrusions 652*a* to the diaphragm 551 may decrease. Accordingly, the diaphragm 551 may be deformed to be recovered to the state shown in FIG. 14A by an elastic force of the diaphragm 551. When the diaphragm 551 is deformed to be recovered to the state shown in FIG. 14A, the plate member 652 may also move upward by being pressed by the diaphragm 551.

As described above, the diaphragm 551 may be deformed such that the cross section of the aperture 112 decreases as the temperature of the ink in the individual ink flow path 132 increases with this embodiment. Also, the diaphragm 551 may be deformed such that the cross section of the aperture 112 increases as the temperature of the ink in the individual ink flow path 132 decreases. Accordingly, the performance of re-filling the ink from the sub-manifold flow path 105*a* to the pressure chamber 110 may be hardly changed regardless of the ink temperature.

Also, the plate member 652 may move downward by the thermal expansion of the thermally deformable member 651. The movement distance of the plate member 652 may be larger than the displacement amount of the thermally deformable member 651 by the thermal expansion by the function of the displacement increasing mechanism 650*a*. Thus, the deformation amount of the diaphragm 551 may be able to be increased.

Further, the cross section of the aperture 112 may be changed by deforming the diaphragm 551 by the diaphragm biasing member 650. Accordingly, the change amount in cross section of the aperture 112 may be able to be adjusted by adjusting the configuration of the diaphragm biasing member 650. Herein, the diaphragm biasing member 650 may be provided separately from the wall portion of the ink flow path. Hence, the degree of freedom of design for the shape, structure, and material may be large. Thus, the deformation of the diaphragm 551 in accordance with the change in temperature may be able to be easily adjusted as compared with the case in which the thermal expansion of the wall portion of the ink flow path is used.

The displacement increasing mechanism 650*a* included in the above-described embodiment is an example of a mechanism for increasing the displacement amount of the thermally deformable member 651. Hence, the displacement increasing mechanism 650*a* may have another structure as long as it is the mechanism having that function. For example, while the supporting members 655 and 657 rotatably support the end portions of the arm members 662 and 661, members, such as the supporting members 654 and 656, which support the end portions of the arm members 662 and 661 movably in the sub-scanning direction may be used instead of the supporting members 655 and 657. Also, the supporting shaft 653 may be located at the middle position in each length direction of the arm members 661 and 662. However, the supporting shaft 653 may be located at a position other than the middle position. The position may be determined such that a distance from the upper end of the arm member 661 to the supporting shaft 653 is equivalent to a distance from the upper end of the arm member 662 to the supporting shaft 653.

The displacement increasing mechanism 650*a* may move the plate member 652 downward in parallel. This is because the protrusion 652*a* securely contacts a region of the diaphragm 551, the region being overlapped with the aperture 112 in plan view. However, if the plate member 652 is permitted to move horizontally by a certain distance when the plate member 652 moves downward, the arrangement of the supporting members 656 and 657 may be reversed in the displacement increasing mechanism 650*a*. At this time, the supporting member 656 may support the lower end portion of the arm member 661, whereas the supporting member 657 may support the lower end portion of the arm member 662. Also, if the plate member 652 is permitted to be inclined from the horizontal direction by a certain angle when the plate member 652 moves downward, the structure of the displacement increasing mechanism 650*a* may be selected from a variety of conceivable structures. For example, the lengths of the arm members 661 and 662 may not have to be equivalent.

Now, still another embodiment of the present invention is described. Note that description of components in this embodiment similar to that in the above-described embodiments is omitted. Also, numerals for description in this embodiment similar to those in the above-described embodiments refer similar components. In this embodiment, the flow-path unit 609 in the above-described embodiment is replaced with the flow-path unit 709.

Figure 15:
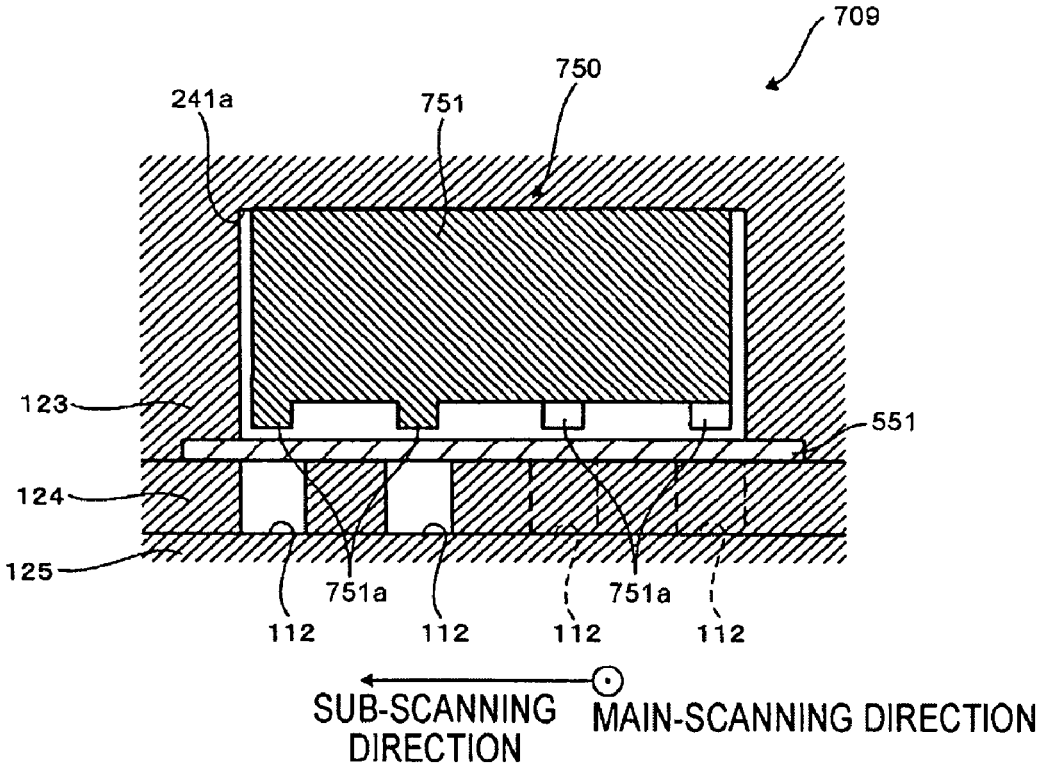
FIG. 15 is a cross-sectional view of a head body according to another embodiment.

Referring to FIG. 15 a diaphragm biasing member 750 may be provided in the sub-chamber 241*a* in the flow-path unit 709. The diaphragm biasing member 750 may comprise a thermally deformable member 751. The thermally deformable member 751 may be fixed to the ceiling surface of the sub-chamber 241*a*, so as to extend over a plurality of apertures 112 in the sub-scanning direction. The thermally deformable member 751 may extend longer in the vertical direction than the thermally deformable member 651 does. A plurality of protrusions 751*a* may be directly fixed onto a lower surface of the thermally deformable member 751. Each protrusion 751*a* may oppose the aperture 112 with the diaphragm 551 interposed therebetween.

Each protrusion 751*a* may bias the diaphragm 551 downward when the thermally deformable member 751 is thermally expanded downward, and may cause the diaphragm 551 to be bent to bulge inward of the aperture 112. Also, when the temperature of the ink in the aperture 112 decreases, the protrusion 751*a* may move away from the diaphragm 551. Accordingly, the diaphragm 551 may be deformed to be recovered to the state shown in FIG. 15 by the elastic force of the diaphragm 551. Accordingly, the diaphragm 551 may be able to be deformed such that the cross section of the aperture 112 decreases as the temperature of the ink in the individual ink flow path 132 increases. Also, the diaphragm 551 may be able to be deformed such that the cross section of the aperture 112 increases as the temperature of the ink in the individual ink flow path 132 decreases. Accordingly, the performance of re-filling the ink from the sub-manifold flow path 105*a* to the pressure chamber 110 may be hardly changed regardless of the ink temperature. The thermally deformable member 751 may be elongated as possible in the vertical direction such that the deformation amount of the thermally deformable member 751 in the vertical direction by the thermal expansion becomes large.

The deformation of the diaphragm 551 in accordance with the change in temperature may be able to be easily adjusted as compared with the case in which the thermal expansion of the wall portion of the ink flow path is used, with this embodiment.

The present invention is not limited to the above-described embodiments, and various modifications can be made within the scope of the invention. For example, in any of the above-described embodiments, the diaphragm for deforming the individual ink flow path 132 may be arranged to define the inner wall surface of the aperture 112. However, the diaphragm may be arranged at any position as long as the diaphragm is arranged between the pressure chamber 110 and the sub-manifold flow path 105*a*.

In the above-described embodiments, while the air chamber 241 may be formed at the base plate 123, the air chamber 241 may be formed at the supply plate 125 so as to be overlapped with the aperture 112 in plan view. In this case, the diaphragm 151 may be positioned between the aperture plate 124 and the supply plate 125 so as to separate the aperture 112 from the sub-chamber 241*a*.

Although embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims which follow.

What is claimed is:

1. An inkjet head, comprising:

an ejection port which ejects ink;

an ink flow path which supplies the ink to the ejection port;

an ejection actuator which supplies ejection energy to the ink in the ink flow path, the ejection energy causing the ink to be ejected from the ejection port;

a wall portion located at a position farther from the ejection port along the ink flow path than a position at which the ejection energy is supplied, the wall portion defining an inner wall surface of the ink flow path;

a temperature sensor configured to detect a temperature of the ink in the flow path; and a controller configured to cause the wall portion to be deformed based on a temperature detected by the temperature sensor such that a cross section of the ink flow path in a direction orthogonal to an ink-flow direction decreases as the temperature detected by the temperature sensor increases, and the cross section of the ink flow path in the direction orthogonal to the ink-flow direction increases as the temperature detected by the temperature sensor decreases.

2. The inkjet head according to claim 1, further comprising a fluid chamber in which a part of an inner wall surface of the fluid chamber is defined by the wall portion, and which opposes the ink flow path with the wall portion interposed therebetween, and a pump configured to change a pressure in the fluid chamber such that the wall portion is deformed, and wherein the controller controls the pump such that the pressure in the fluid chamber increases as the temperature detected by the temperature sensor increases, and the pressure in the fluid chamber decreases as the temperature detected by the temperature sensor decreases.

3. The inkjet head according to claim 2, wherein the fluid chamber is filled with gas.

4. The inkjet head according to claim 1, further comprising:

an electromagnet configured to generate a magnetic field so as to deform the wall portion, and a current supply device configured to supply current to the electromagnet, wherein the controller is configured to control the current supplied to the electromagnet by the current supply device such that the magnetic field generated by the electromagnet causes the cross section of the ink flow path in the direction orthogonal to the ink-flow direction to decrease as the temperature detected by the temperature sensor increases, and the cross section of the ink flow path in the direction orthogonal to the ink-flow direction to increase as the temperature detected by the temperature sensor decreases, and wherein the wall portion is made of a ferromagnetic material.

5. The inkjet head according to claim 4, wherein the electromagnet generates the magnetic field such that the wall portion is bent to bulge outward of the ink flow path when no current is supplied by the current supply device, and the wall portion is bent to bulge inward of the ink flow path when the current is supplied by current supply device.

6. The inkjet head according to claim 1, wherein the wall portion is made of a thin flexible member.

7. An inkjet head comprising:

an ejection port which ejects ink;

an ink flow path which supplies the ink to the ejection port;

an ejection actuator which supplies ejection energy to the ink in the flow path, the ejection energy causing the ink to be ejected from the ejection port; and a wall portion located at a position farther from the ejection port along the ink flow path than a position at which the ejection energy is supplied, the wall portion defining an inner wall surface of the ink flow path;

wherein the wall portion deforms to decrease a cross section of the ink flow path in a direction orthogonal to an ink-flow direction as a temperature of the ink in the ink flow path increases, and the wall portion deforms to increase a cross section of the ink flow path in a direction orthogonal to an ink-flow direction as the temperature of the ink in the ink flow path decreases wherein the ejection actuator supplies the ejection energy by applying a pressure to the ink in the ink flow path, wherein a part of the ink flow path is an ink-limiting portion configured to reflect a pressure wave generated when the ejection actuator applies the pressure to the ink in the ink flow path, and wherein the wall portion defines at least a part of an inner wall surface of the part of the ink flow path.

8. An inkjet head comprising:

a gas chamber which defines a sealed space containing gas;

an ejection port which ejects ink;

an ink flow path which supplies the ink to the ejection port;

an ejection actuator which supplies ejection energy to the ink in the ink flow path, the ejection energy causing the ink to be ejected from the ejection port; and a wall portion located at a position farther from the ejection port along the ink flow path than a position at which the ejection energy is supplied, the wall portion defining an inner wall surface of the ink flow path;

wherein the wall portion defines a part of an inner wall surface of the gas chamber, and wherein the gas in the gas chamber causes a pressure applied to the wall portion to change in accordance with a temperature of the ink in the ink flow path, and bends the wall portion such that a cross section of the ink flow path in a direction orthogonal to the ink-flow direction decreases as the temperature of the ink in the ink flow path increases, and the cross section of the ink flow path in the direction orthogonal to the ink-flow direction increases as the temperature of the ink in the ink flow path decreases.

9. The inkjet head according to claim 8, wherein the gas chamber contains liquid in addition to the gas.

10. The inkjet head according to claim 8, wherein the wall portion is made of a thin flexible member.

11. An inkjet head comprising:

an ejection port which ejects ink;

an ink flow path which supplies the ink to the ejection port;

an ejection actuator which supplies ejection energy to the ink in the flow path, the ejection energy causing the ink to be ejected from the ejection port;

a wall portion located at a position farther from the ejection port along the ink flow path than a position at which the ejection energy is supplied, the wall portion defining an inner wall surface of the ink flow path; and a biasing member which biases the wall portion in a direction intersecting with the inner wall surface defined by the wall portion, wherein the biasing member increases a biasing force to be applied to the wall portion in accordance with a temperature of the ink in the ink flow path when the wall portion is thermally expanded in the direction intersecting with the inner wall surface, and bends the wall portion such that a cross section of the ink flow path in a direction orthogonal to an ink-flow direction decreases as the temperature of the ink in the ink flow path increases, and the cross section of the ink flow path in the direction orthogonal to the ink-flow direction increases as the temperature of the ink in the ink flow path decreases.

12. The inkjet head according to claim 11, wherein the ejection actuator supplies the ejection energy by applying a pressure to the ink in the ink flow path, wherein a part of the ink flow path is configured to reflect a pressure wave generated when the ejection actuator applies the pressure to the ink in the ink flow path, and wherein the wall portion defines at least a part of an inner wall surface of the part of the ink flow path.

13. The inkjet head according to claim 12, wherein the ejection port is one of a plurality of ejection ports, the part of the ink flow path is one of a plurality of parts of the ink flow path, and the wall portion is one of a plurality of wall portions which define inner wall surfaces of the parts of the ink flow path, wherein the ink flow path comprises a plurality of individual ink flow paths which respectively comprise the parts of the ink flow path and respectively communicate with the ejection ports, wherein the parts of the ink flow path extend along a plane, and wherein the biasing member comprises a thermally deformable member opposing the parts of the ink flow path with the wall portions interposed therebetween, the thermally deformable member being thermally expanded in accordance with the temperature of the ink in the ink flow path, and a plurality of protrusions respectively protruding toward the wall portions, wherein the biasing member biases the protrusions toward the wall portions when the thermally deformable member is thermally expanded.

14. The inkjet head according to claim 13, wherein the biasing member further comprises a displacement increasing mechanism which displaces the protrusions toward the wall portions by a deformation amount larger than a displacement amount of the thermally expandable member when being thermally expanded.

15. The inkjet head according to claim 14, further comprising a plate member, the protrusions being fixed onto one surface of the plate member, the plate member being movable toward the parts of the ink flow path, and wherein the displacement increasing mechanism comprises:

plate-like first and second arm members having equivalent lengths, a first supporting member which supports the first and second arm members mutually rotatably such that a distance from one end of the first arm member to a rotation axis is equivalent to a distance from one end of the second arm member to the rotation axis, second and third supporting members which support the one end of the first arm member and the one end of the second arm member rotatably around axes being parallel to the rotation axis, and fourth and fifth supporting members which support another end of the first arm member and another end of the second arm member rotatably around axes being parallel to the rotation axis, the fourth and fifth supporting members being fixed on another surface being parallel to the one surface of the plate member, wherein the second and third supporting members support the one end of the first arm member and the one end of the second arm member such that a distance between the first and second arm members is changeable and that a distance from the first arm member to the parts of the ink flow path and a distance from the second arm member to the parts of the ink flow path are held constant in a direction orthogonal to the plane, the fourth and fifth supporting members support the another end of the first arm member and the another end of the second arm member such that the distance between the first and second members is changeable, and the thermally deformable member biases the first supporting member in a direction toward the plate member when the thermally deformable member is thermally expanded in accordance with the temperature of the ink in the ink-flow path.

16. The inkjet head according to claim 11, wherein the wall portion is made of a thin flexible member.

17. A method of controlling the flow of ink in an inkjet head wherein an ejection port ejects ink, an ink flow path supplies the ink to the ejection port, and an ejection actuator supplies ejection energy to the ink in the ink flow path, the ejection energy causing the ink to be ejected from the ejection port, wherein a wall portion is located at a position farther from the ejection port along the ink flow path than a position at which the ejection energy is supplied, the wall portion defining an inner wall surface of the ink flow path, the method comprising:

detecting a temerature of the ink in the ink flow path;

deforming the wall portion to decrease a cross section of the ink flow path in a direction orthogonal to an ink-flow direction when the detected temperature of the ink in the ink flow path increases, and deforming the wall portion to increase a cross section of the ink flow path in a direction orthogonal to an ink-flow direction when the detected temperature of the ink in the ink flow path decreases.

* * * * *

UNITED STATES PATENT AND TRADEMARK OFFICE

CERTIFICATE OF CORRECTION

PATENT NO. : 8,104,858 B2
APPLICATION NO. : 12/341025
DATED : January 31, 2012
INVENTOR(S) : Masahito Kato et al.

It is certified that error appears in the above-identified patent and that said Letters Patent is hereby corrected as shown below:

In Column 24, Claim 17, Line 35
Please replace “temerature” with --temperature--

Signed and Sealed this
Twelfth Day of June, 2012

David J. Kappos

David J. Kappos
*Director of the United States Patent and Trademark Office*